US009890933B2

(12) United States Patent
Hirano et al.

(10) Patent No.: US 9,890,933 B2
(45) Date of Patent: Feb. 13, 2018

(54) HOLDER OF LIGHT-EMITTING MODULE, AND LIGHTING APPARATUS

(71) Applicant: PANASONIC INTELLECTUAL PROPERTY MANAGEMENT CO., LTD., Osaka (JP)

(72) Inventors: Akihiro Hirano, Shiga (JP); Ryusuke Kotera, Osaka (JP); Katsushi Seki, Shiga (JP); Youji Tachino, Nara (JP); Satoshi Fukano, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 256 days.

(21) Appl. No.: 14/827,607

(22) Filed: Aug. 17, 2015

(65) Prior Publication Data

US 2016/0076744 A1 Mar. 17, 2016

(30) Foreign Application Priority Data

Sep. 11, 2014 (JP) ..... 2014-185674
Sep. 12, 2014 (JP) ..... 2014-185963

(51) Int. Cl.

| | |
|---|---|
| ***F21V 19/00*** | (2006.01) |
| ***H01R 12/70*** | (2011.01) |
| *H01R 4/48* | (2006.01) |
| *H01R 12/51* | (2011.01) |
| *F21Y 115/10* | (2016.01) |

(52) U.S. Cl.
CPC ..... *F21V 19/0015* (2013.01); *H01R 12/7076* (2013.01); *F21Y 2115/10* (2016.08); *H01R 4/4809* (2013.01); *H01R 12/515* (2013.01)

(58) Field of Classification Search
CPC ..... F21V 19/0015; H01R 12/7076; H01R 12/515; H01R 4/4809; F21Y 2115/10
See application file for complete search history.

(56) References Cited

U.S. PATENT DOCUMENTS

| | | | | |
|---|---|---|---|---|
| 8,427,048 | B2 * | 4/2013 | Konishi | F21K 9/00 313/505 |
| 8,632,226 | B2 * | 1/2014 | Hata | F21V 11/06 362/249.02 |
| 9,039,257 | B2 | 5/2015 | Noro et al. | |
| 9,188,321 | B2 * | 11/2015 | Agatani | H01L 25/0753 |
| 2003/0218417 | A1 * | 11/2003 | Chin | H05K 5/0017 313/498 |
| 2006/0087843 | A1 * | 4/2006 | Setomoto | H05B 33/0803 362/249.01 |
| 2012/0236532 | A1 | 9/2012 | Koo et al. | |
| 2014/0217433 | A1 * | 8/2014 | Tudorica | H01L 33/56 257/89 |

* cited by examiner

*Primary Examiner* — Mary Ellen Bowman
(74) *Attorney, Agent, or Firm* — Greenblum & Bernstein, P.L.C.

(57) ABSTRACT

A holder included in a plurality of holders which fix, to a base, a light-emitting module to be placed on the base, by being attached to the base, includes: a contact terminal to be electrically connected to the light-emitting module; and a holding component which holds the light-emitting module in a cantilever-style when the holder is unattached to the base.

5 Claims, 19 Drawing Sheets

HOLDER OF LIGHT-EMITTING MODULE, AND LIGHTING APPARATUS

CROSS REFERENCE TO RELATED APPLICATION

This application claims the benefit of priorities of Japanese Patent Application Number 2014-185674, filed Sep. 11, 2014, and Japanese Patent Application Number 2014-185963, filed Sep. 12, 2014, the entire contents of which are hereby incorporated by reference.

BACKGROUND OF THE INVENTION

1. Field of the Invention

The present disclosure relates to a holder for fixing a light-emitting module to a base, and a lighting apparatus including the holder.

2. Description of the Related Art

In recent years, an LED (light emitting diode) lighting is rapidly in widespread use from the perspective of energy-saving. An LED lighting is, for example, configured by attaching an LED module including a plurality of LEDs disposed on a substrate to a base of an LED lighting (equipment body, for example) (see US Patent Application Publication NO. 2012/0236532, for example).

SUMMARY OF THE INVENTION

When attaching an LED module to a base, the LED module needs to be able to dissipate heat. For that reason, it is necessary to mechanically and thermally connect the LED module and the base.

There is a holder which has the above-described function and which allows connection of an external power line. In other words, there is an LED lighting which supplies an LED module with power for light-emission via a holder.

In addition, in some LED lightings, an LED module is fixed by pressing, toward a base, end portions of the LED module respectively using two holders, for example.

Two holders respectively press only the end portions on which electrodes of the LED module are disposed in order to fix the LED module, and thus it is possible to use the holders for fixing a plurality of LED modules which are different in size.

However, when fixing the LED module to the base using the two holders, it is necessary, for example, to sequentially place the holders at two end portions of the LED module, while holding by hand the LED module arranged at a predetermined position of the base, and fix the LED module by a screw or the like. In addition, it is necessary, during the series of operations, to accurately align each of the holders and the LED module to the base, in order to stably maintain electrical connection between each of the holders and the LED module.

In other words, when a plurality of holders supply the LED module with power and fix the LED module to the base, there is a problem that assembly work of an LED lighting becomes cumbersome.

In view of the above-described conventional problems, an object of the present disclosure is to provide: a holder which is one of a plurality of holders that supply a light-emitting module with power and fix the light-emitting module to the base, and facilitates the operation for the fixing; and a lighting apparatus including the holder.

A holder according to an aspect of the present disclosure is a holder included in a plurality of holders which fix, to a base, a light-emitting module to be placed on the base, by being attached to the base, the holder including: a contact terminal to be electrically connected to the light-emitting module; and a holding component which holds the light-emitting module in a cantilever-style when the holder is unattached to the base. A lighting apparatus according to an aspect of the present disclosure includes: a base; a light-emitting module to be placed on the base; and a plurality of holders which fix the light-emitting module to the base, wherein each of the plurality of holders includes: a contact terminal to be electrically connected to an electrode of the light-emitting module; and a holding component which holds the light-emitting module in a cantilever-style when the holder is unattached to the base.

With the holder according to an aspect of the present disclosure, it is possible to supply power to the light-emitting module and to facilitate the work for fixing the light-emitting module to the base.

In addition, with lighting apparatus according to an aspect of the present disclosure, attachment of the holder which supplies power to the light-emitting module and fixes light-emitting module to the base is easily carried out.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE PREFERRED EMBODIMENTS

A lighting apparatus according to exemplary embodiments will be described below with reference to the drawings. It is to be noted that each of the exemplary embodiments described below shows a preferable specific example of the present disclosure. Thus, the numerical values, shapes, materials, constituent elements, the disposition and connection of the constituent elements, and others described in the following exemplary embodiments are mere examples, and do not intend to limit the present disclosure. Therefore, among the constituent elements in the following exemplary embodiments, constituent elements not recited in any one of the independent claims which represent the most generic concepts of the present disclosure are described as arbitrary constituent elements.

In addition, each of the diagrams is a schematic diagram and thus is not necessarily strictly illustrated. In each of the diagrams, substantially the same constituent elements are assigned with the same reference signs, and there are instances where redundant descriptions are omitted or simplified.

A lighting apparatus according to exemplary embodiments will be described below with reference to the drawings.

Embodiment 1

First, a lighting apparatus according to Embodiment 1 will be described with reference to FIG. 1 and FIG. 2.

Figure 1:
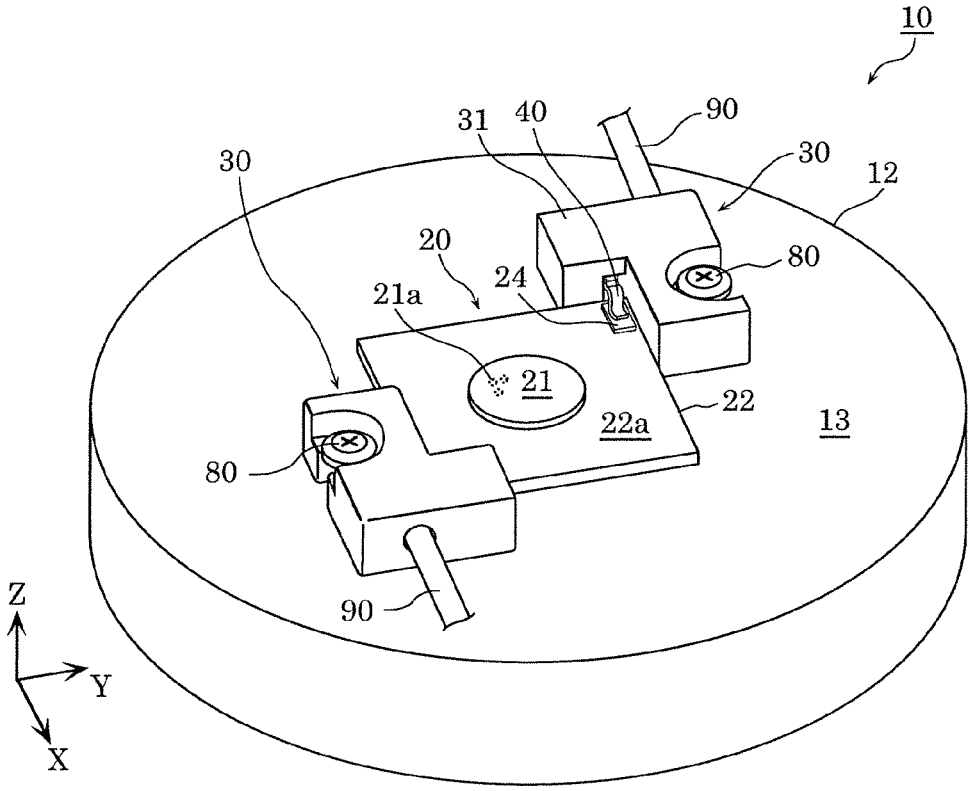
FIG. 1 is a perspective view illustrating a basic configuration of a lighting apparatus according to Embodiment 1.

FIG. 1 is a perspective view illustrating a basic configuration of lighting apparatus 10 according to Embodiment 1.

Figure 2:
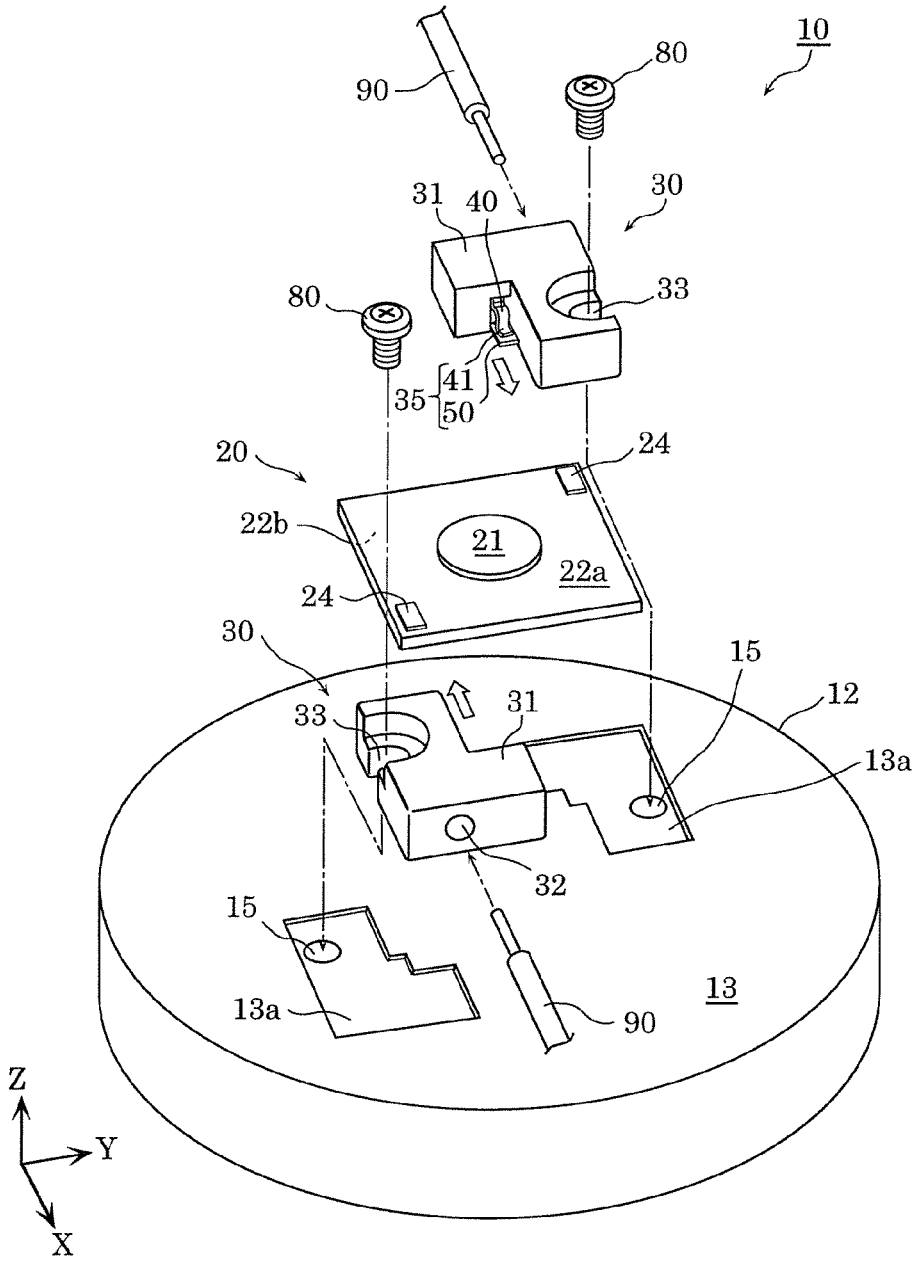
FIG. 2 is an exploded perspective view corresponding to FIG. 1.

FIG. 2 is an exploded perspective view corresponding to FIG. 1

As illustrated in FIG. 1 and FIG. 2, lighting apparatus 10 according to Embodiment 1 includes: base 12; light-emitting module 20 to be placed on base 12; a plurality of holders 30 for fixing light-emitting module 20 to base 12.

Holders 30 each have contact terminal 40 to be electrically connected to light-emitting module 20, and holding component 35 which holds light-emitting module 20 in a cantilever-style when holder 30 is unattached to base 12.

It is to be noted that lighting apparatus 10 may include other components such as a light-transmissive cover disposed to cover light-emitting module 20, other than the elements illustrated in FIG. 1 and FIG. 2. Illustration and description of the other elements, however, are omitted in order to specifically describe a feature of lighting apparatus 10 according to the present exemplary embodiment.

In addition, single light-emitting module 20 is placed on base 12 according to the present exemplary embodiment. However, the number of light-emitting modules 20 is not limited, and a plurality of light-emitting modules 20 may be arranged side-by-side on base 12.

Lighting apparatus 10 according to the present exemplary embodiment is a lighting apparatus used as a so-called downlight which is recessed in the ceiling with light-emitting module 20 facing downward, for example. There is no particular limitation on an orientation of lighting apparatus 10 in use. Lighting apparatus 10 illustrated includes light-emitting module 20 facing upward (in the direction of axis Z) according to the present exemplary embodiment.

Light-emitting module 20 includes: substrate 22; and light emitter 21 disposed on main surface 22*a* of substrate 22. In the present exemplary embodiment, substrate 22 is a substrate which has a rectangular flat-plate shape. It is preferable that substrate 22 is configured of a material having high thermal conductivity, and an alumina substrate made of alumina is used, for example.

It is to be noted that, other than the alumina substrate, various substrates such as other ceramic substrates made of aluminum nitride or the like, a metal substrate made of aluminum, copper, or the like, and a resin substrate, and a metal base substrate having a layered structure of metal and resin may be employed as substrate 22.

Light emitter 21 disposed on main surface 22*a* of substrate 22 includes one or more light-emitting elements each of which emits light forward.

According to the present exemplary embodiment, light emitter 21 includes one or more LED chips 21*a* mounted on substrate 22, and a sealing component. Each of LED chips 21*a* is mounted on main surface 22*a* of substrate 22 through die bonding or the like.

In addition, the sealing component collectively seals LED chips 21*a* arranged in a matrix, according to the present exemplary embodiment.

As LED chip 21*a*, a blue LED chip which emits blue light having a center wavelength of 440 nm to 470 nm are used, for example.

In addition, a phosphor-containing resin which is a resin that seals to protect LED chip 21*a*, and includes a phosphor that converts a wavelength of light emitted from LED chip 21*a* is exemplified as the sealing component.

More specifically, when LED chip 21*a* employs blue emitting LED, for example, a phosphor-containing resin formed by dispersing YAG (yttrium, aluminum, garnet) yellow phosphor particles on a silicone resin may be used as the sealing component in order to obtain white light. With this configuration, light emitter 21 (sealing component) emits white light resulting from yellow light having a wavelength converted by the phosphor particles and blue light emitted from LED chip 21*a*.

In addition, an outer diameter of light emitter 21 is, for example, 5 mm to 50 mm. Light emitter 21 having an outer diameter of 15 mm is disposed on light-emitting module 20 in lighting apparatus 10 according to the present exemplary embodiment.

It is to be noted that, although light emitter 21 having a round shape is exemplified in the present exemplary embodiment, an overall shape of light emitter 21 is not limited to the round shape. For example, a rectangle may be employed as the overall shape of light emitter 21.

In addition, how to seal LED chips 21*a* using the sealing component is not limited. For example, LED chips 21*a* may be sealed one by one, or may be sealed for each line.

In addition, when conversion of wavelength of light emitted from LED chip 21 is not required, for example, one or more LED chips 21*a* arranged on substrate 22 are not necessarily sealed by the sealing component.

Furthermore, a pair of electrodes 24 are disposed on main surface 22*a* of substrate 22. Each of LED chips 21*a* included in light emitter 21 is supplied with power for light emission, via a wiring pattern (not illustrated) connected to the pair of electrodes 24.

Light emitting module 20 including LED chips 21*a* as a light source is fixed to base 12.

Base 12 is a metal base shaped like a columnar pedestal according to the present exemplary embodiment, and disposed to contact, at placement face 13 thereof, with a surface of light-emitting module 20, thereby effectively releasing heat generated in light-emitting module 20. In other words, base 12 is a component which functions as a heat sink for diffusing heat of light-emitting module 20.

It is to be noted that the shape of base 12 is not limited to the columnar pedestal, and may be a cuboid, for example. In addition, base 12 may have a wall surrounding a region in which light-emitting module 20 is placed.

Light-emitting module 20 is fixed to base 12 by two holders 30 according to the present exemplary embodiment. More specifically, two holders 30 are arranged so as to hold two portions which are positioned diagonally in light-emitting module 20 having a rectangle shape.

Two holders 30 are equivalent components in the present exemplary embodiment, and thus it is possible, for example, to exchange holder 30 on the right with holder 30 on the left in the arrangement illustrated in FIG. 1. In other words, a feature of holder 30 described below is applied to both of two holders 30 included in lighting apparatus 10.

Holder 30 includes main body 31 on which contact terminal 40 is disposed. According to the present exemplary embodiment, main body unit 31 includes a space in which external power line 90 to be electrically connected to contact terminal 40 is housed.

More specifically, main body 31 has insertion opening 32 defined on one of side surfaces, and power line 90 inserted through insertion opening 32 is electrically connected to contact terminal 40 inside main body 31.

It is to be noted that power line 90 is connected to a lighting apparatus disposed on a back side of a ceiling, for example, and pulled out to the side faced by placement face 13 of base 12, through an opening (not illustrated) defined in base 12 or an opening defined in a vicinity of the position at which base 12 is recessed in the ceiling, for example. The lighting apparatus is an apparatus for converting commercial power supply, for example, to power having characteristics suitable to light emission of light-emitting module 20.

More specifically, light-emitting module 20 electrically connected to contact terminal 40 receives power supplied from power line 90 via contact terminal 40, and emits light using the power received.

In addition, main body 31 further includes holding component 35. According to the present exemplary embodiment, holding component 35 clamps a portion of light-emitting module 20 between contact portion 41 of contact terminal 40 and support plate 50. Holding component 35 will be described later in detail with reference to FIG. 3 to FIG. 6.

Main body 31 is manufactured by, for example, molding synthetic resin having insulation properties, such as PBT (polybutylene terephthalate).

Main body 31 includes screw attaching portion 33 through which screw 80 penetrates as illustrated in FIG. 2. Holder attaching portion 13*a* formed into a recess shape is defined on placement face 13 of base 12, and threaded hole 15 into which screw 80 is screwed is defined in holder attaching portion 13*a*. Holder 30 is attached to holder attaching portion 13*a* having a recess shape, thereby enabling light-emitting module 20 having back surface 22*b* in contact with support plate 50 to be in surface-to-surface contact with placement face 13.

It is to be noted that placement face 13 of base 12, for example, may have a contact surface portion which is higher by a thickness of support plate 50 than a position at which light-emitting module 20 is attached, thereby causing light-emitting module 20 to be in surface-to-surface contact with placement face 13.

Light-emitting module 20 is placed on base 12 with holders 30 each being attached to a corresponding one of two end portions where electrodes 24 are disposed, and holders 30 are threaded to base 12 by screw 80, thereby being fixed to base 12.

Next, a characteristic configuration of holder 30 according to the present exemplary embodiment will be described with reference to FIG. 3 through FIG. 5.

Figure 3:
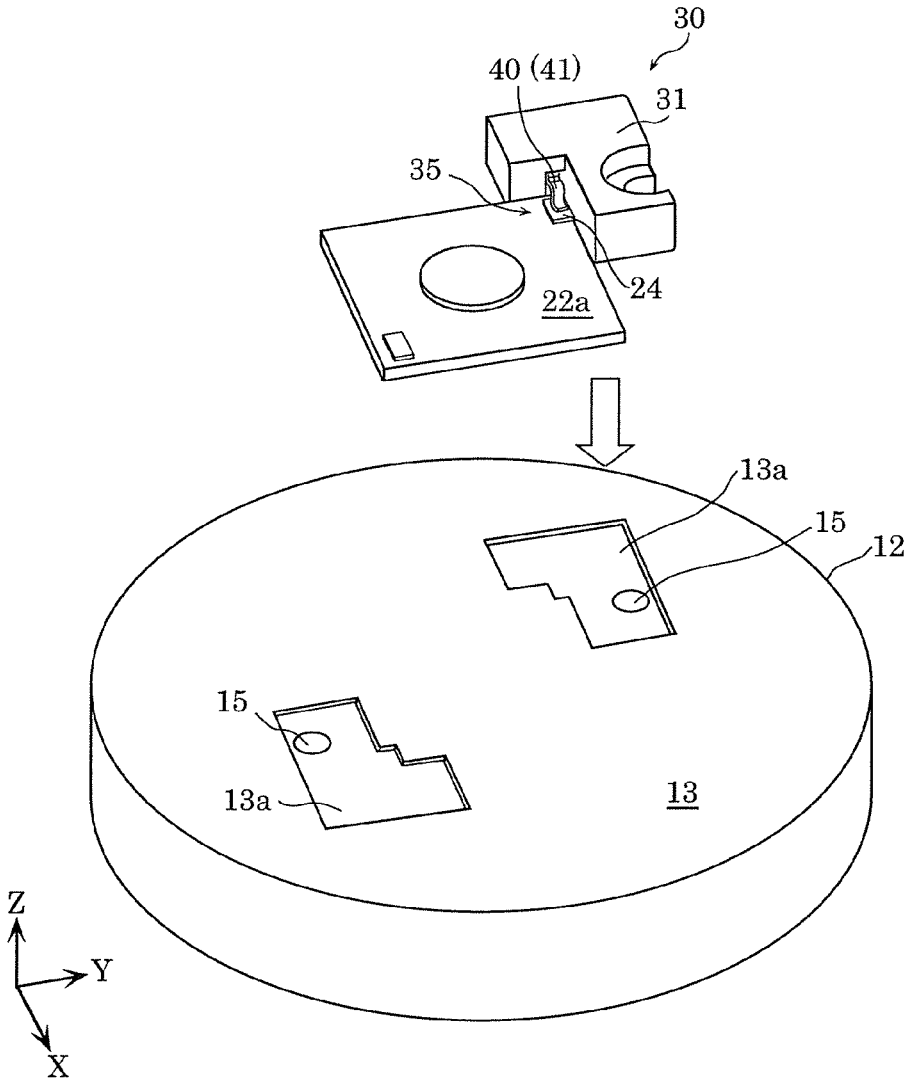
FIG. 3 is a perspective view illustrating a holder according to Embodiment 1 which holds a light-emitting module in a cantilever-style.

FIG. 3 is a perspective view illustrating holder 30 according to Embodiment 1 holding light-emitting module 20 in a cantilever-style.

Figure 4:
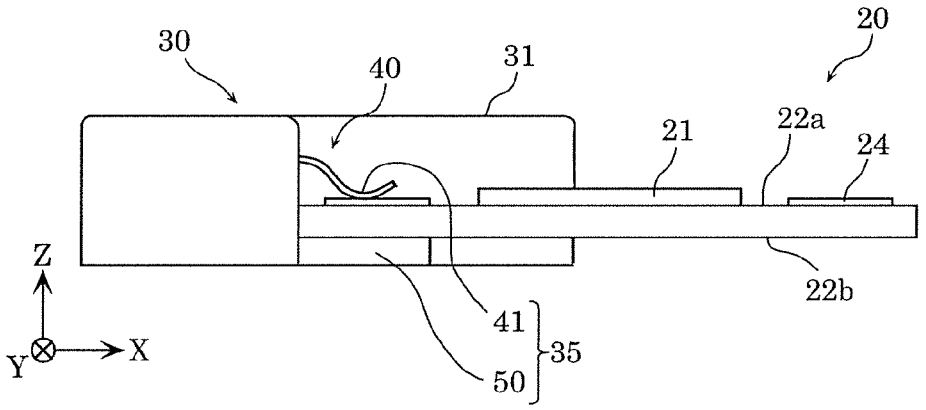
FIG. 4 is a side view illustrating an overview of a holding component according to Embodiment 1.

FIG. 4 is a side view illustrating an overview of holding component 35 according to Embodiment 1.

Figure 5:
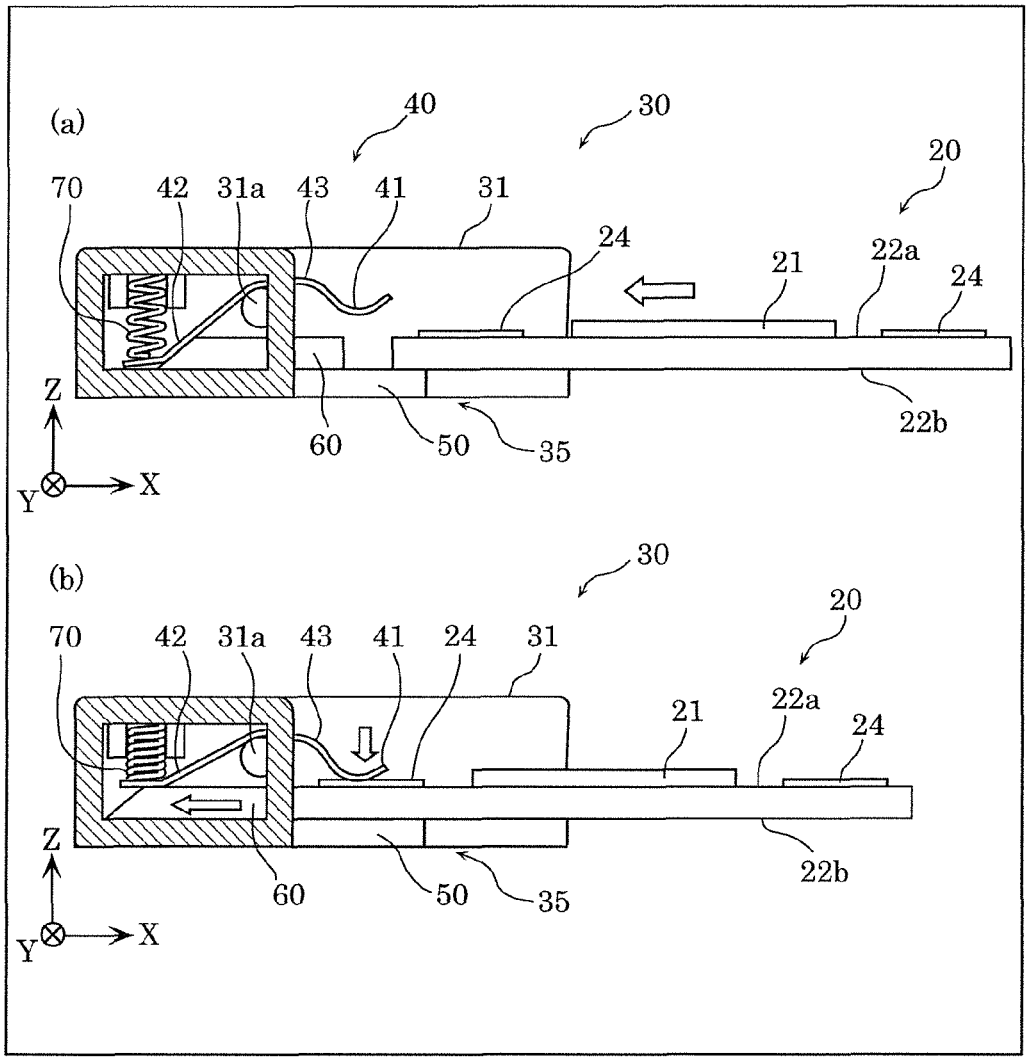
FIG. 5 is a diagram illustrating an operation of the holding component according to Embodiment 1.

FIG. 5 is a diagram illustrating an operation of holding component 35 according to Embodiment 1.

It is to be noted that FIG. 5 illustrates a cross-sectional view of holder 30 disposed on the right in FIG. 1, which is taken from plane XZ passing a position on the left of contact terminal 40, for enabling visually comprehending an operation of holding component 35. In addition, light-emitting module 20 is illustrated in a side view. The above-stated items are also applied to FIG. 6 and FIG. 7 which will be described later.

As illustrated in FIG. 3, holding component 35 included by holder 30 is capable of holding light-emitting module 20 in the cantilever-style when holder 30 is unattached to base 12.

More specifically, holding component 35 holds light-emitting module 20 in the cantilever-style by clamping a portion of light-emitting module 20 from the side faced by back surface 22*b* which is a surface to be in contact with base 12 and from the side face by main surface 22*a* which is a surface opposite to back surface 22*b*, as illustrated in FIG. 4.

In other words, holding component 35 holds light-emitting module 20 by clamping a portion of light-emitting module 20 in the thickness direction. With this, it is possible to stably hold light-emitting module 20.

More specifically, according to the present exemplary embodiment, holding component 35 includes: contact portion 41 which is a portion of contact terminal 40 to be in contact with electrode 24 disposed on main surface 22*a* of light-emitting module 20; and support plate 50 disposed at an position opposite to contact portion 41. Holding component 35 holds light-emitting module 20 in the cantilever-style by clamping, with contact portion 41 and support plate 50, a portion of light-emitting module 20 that is an end portion on which electrode 24 is disposed.

More specifically, a portion (contact portion 41) of contact terminal 40 having elasticity, which is in contact with light-emitting module 20 is used as a component for clamping a portion of light-emitting module 20, thereby allowing a simple configuration for holding light-emitting module 20, for example.

In addition, holding component 35 according to the present exemplary embodiment is structured in such a manner that stability of mechanical and electrical connection between holder 30 and light-emitting module 20 is improved.

More specifically, as illustrated in FIG. 2 and FIG. 5 described above, holder 30 is moved toward light-emitting module 20 in a direction parallel to a contact surface (i.e., back surface 22*b*) between light-emitting module 20 and base 12, and thereby holding component 35 clamps a portion of light-emitting module 20. In addition, contact terminal 40 is subjected to force from light-emitting module 20 when holder 30 is moved toward light-emitting module 20 in the direction parallel to back surface 22*b*, thereby causing contact portion 41 to move toward support plate 50.

In other words, holding component 35 according to the present exemplary embodiment is configured such that contact portion 41 is pressed against electrode 24, using relative movement of light-emitting module 20 and holder 30 for causing holder 30 to hold light-emitting module 20.

To be more specific, as illustrated in (a) and (b) in FIG. 5, holding component further includes button 60 which moves by being pressed by light-emitting module 20 when holder 30 is moved toward light-emitting module 20 in the direction parallel to back surface 22*b*. In this case, contact terminal 40 is subjected to force from light-emitting module 20 via button 60.

As illustrated in (a) and (b) in FIG. 5, button 60 includes an end face which is sloped toward a side opposite to the moving direction (direction parallel to back surface 22*b* of light-emitting module 20; that is, a negative direction of axis X in FIG. 5), and has a function of converting the direction of force received from light-emitting module 20 into a vertical direction (a positive direction of axis Z in FIG. 5).

In addition, contact terminal 40 includes button contacting portion 42 defined at the end portion opposite to contact portion 41. Button contacting portion 42 is biased downward by elastic member (spiral spring, in the present exemplary embodiment) 70 in holder 30, as illustrated in (a) in FIG. 5.

Furthermore, contact terminal 40 is supported by terminal supporter 31*a* included by holder 30, at a location of leaf spring 43 that connects button contacting portion 42 and contact portion 41.

Button 60 comes in contact with button contacting portion 42 of contact terminal 40 in the above-described state, and thereby button contacting portion 42 moves upward against the biasing force of elastic member 70 as illustrated in (b) in FIG. 5.

With this, contact terminal 40 turns in a clockwise direction in (b) in FIG. 5. In other words, contact terminal 40 causes contact portion 41 to move toward support plate 50.

As a result, contact portion 41 is pressed to electrode 24 by the elastic force of leaf spring 43, and thus an end portion of light-emitting module 20 at which electrode 24 is disposed is clamped between contact portion 41 and support plate 50.

In other words, the stability of mechanical and electrical connection between holder 30 that holds light-emitting module 20 in the cantilever-style and light-emitting module 20 is improved.

In addition, stable connection between contact portion 41 and electrode 24 is obtained when light-emitting module 20 is fully pressed against holder 30, as illustrated in (b) in FIG. 5. In other words, as illustrated in (a) in FIG. 5, it is possible to start an operation for attaching holder 30 to light-emitting module 20 in the state where contact portion 41 is positioned higher than electrode 24.

Accordingly, it is possible, for example, to prevent electrode 24 from receiving an excessive frictional force from contact portion 41 resulting from the relative movement of holder 30 and light-emitting module 20 when attaching holder 30 to light-emitting module 20. As a result, it is possible to suppress damage of electrode 24 or contact portion 41 resulting from friction between electrode 24 and contact portion 41.

It is to be noted that, according to the present exemplary embodiment, two holders 30 are attached to light-emitting module 20 corresponding to two electrodes 24 of light-emitting module 20 in a one-to-one correspondence, as illustrated in FIG. 2, for example. More specifically, each of two holders 30 is attached to light-emitting module 20 according to the procedure illustrated in FIG. 5.

As described above, lighting apparatus 10 according to the present exemplary embodiment includes: base 12; light-emitting module 20 to be placed on base 12; and holders 30 for fixing light-emitting module 20 to base 12. Holders 30 each have contact terminal 40 to be electrically connected to electrode 24 of light-emitting module 20, and holding component 35 which holds light-emitting module 20 in the cantilever-style when holder 30 is unattached to base 12.

To put it simply, the above-described configuration allows each of holders 30 to be fixed temporarily to light-emitting module 20, and it is therefore possible to handle holders 30 and light-emitting module 20 as an integrated structural component. In other words, it is possible to place holders 30 and light-emitting module 20 which are integrated at a predetermined position of base 12, and to fix, in the state, each of holders 30 to base 12 using screw 80.

Accordingly, two holders 30 are each capable of supplying power to light-emitting module 20 and fixing light-emitting module 20 to base 12. In addition, two holders 30 are each capable of holding light-emitting module 20 in the cantilever-style independently of the other one of two holders 30 and base 12, in other words, being attached to light-emitting module 20.

With this configuration, it is possible to easily assemble lighting apparatus 10 without cumbersome work such as attaching a plurality of holders sequentially to a base while holding by hand a light-emitting module placed on the base as in a conventional manner.

In other words, it is possible, with holder 30 according to the present exemplary embodiment, to supply power to light-emitting module 20 and to facilitate the work for fixing light-emitting module 20 to base 12.

In addition, with lighting apparatus 10 according to the present exemplary embodiment, attachment of holder 30 which supplies power to light-emitting module 20 and fixes light-emitting module 20 to base 12 is easily carried out.

It is to be noted that the configuration of holder 30 according to Embodiment 1 may differ from the configurations illustrated in FIG. 1 to FIG. 5. The following describes various modifications of holder 30, with a focus on a difference from Embodiment 1.

Modification 1 of Embodiment 1

In Embodiment 1 described above, movable contact terminal 40 includes button contacting portion 42 which receives a biasing force from elastic member 70, as illustrated in FIG. 5. With this configuration, it is possible to suppress backlash of contact terminal 40 when light-emitting module 20 is not held by holding component 35. Furthermore, it is possible to move contact terminal 40 such that contact portion 41 moves toward support plate 50, as a result of elastic deformation of elastic member 70 caused by the force received from button 60.

When such a configuration is employed, holder 30 may include a mechanism for preventing button 60 from being pressed back, in view of the case where button 60 is pressed back by a biasing force of elastic member 70, for example.

Figure 6:
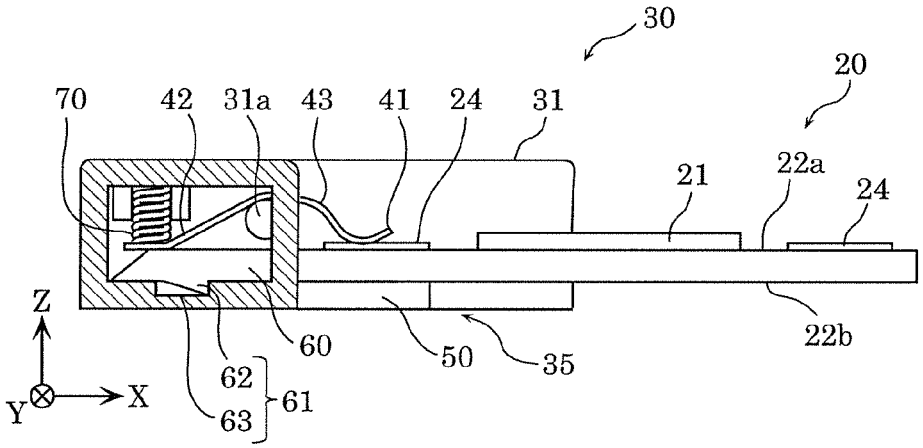
FIG. 6 is a side view illustrating a holder according to Modification 1 of Embodiment 1.

FIG. 6 is a side view illustrating holder 30 according to Modification 1 of Embodiment 1.

Holder 30 illustrated in FIG. 6 includes locking mechanism 61 which locks button 60 for preventing button 60 from moving in an opposite direction when button 60 moves as a result of being pressed by light-emitting module 20.

Locking mechanism 61 includes protrusion 62 protruding from button 60, and recess portion 63 which is defined on main body 31 and is to engage with protrusion 62.

As described above, holder 30 includes lock mechanism 61, and thus it is possible to restrict movement of button 60 so as to prevent, from returning to an original position, button 60 that causes contact terminal 40 to produce a elastic force by which contact portion 41 is pressed to electrode 24. As a result, the possibility that holding component 35 might release light-emitting module 20 due to an external factor such as vibration is reduced.

Modification 2 of Embodiment 1

In Embodiment 1 described above, elastic member 70 that is involved in an operation of movable contact terminal 40 is a spiral spring. However, elastic member 70 may be a spring of other types, a rubber elastic body, etc.

In addition, a part of contact terminal 40 may serve as elastic member 70.

Figure 7:
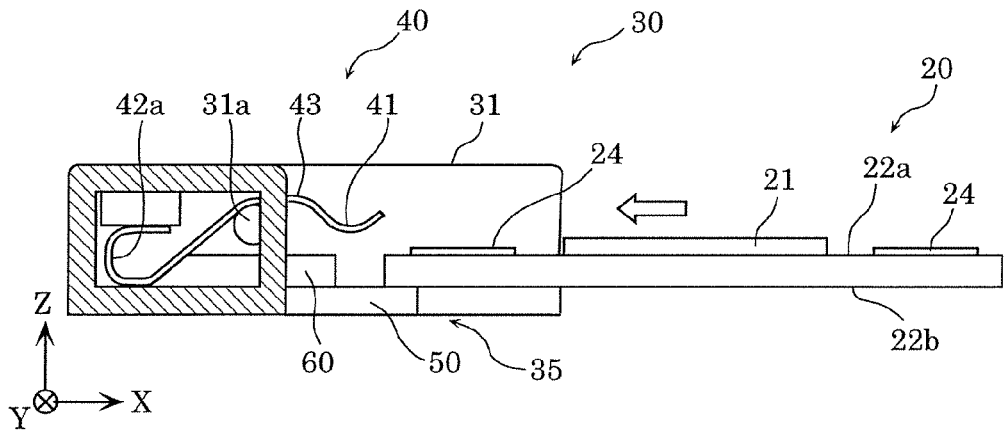
FIG. 7 is a side view illustrating a shape of a contact terminal according to Modification 2 of Embodiment 1.

FIG. 7 is a side view illustrating a shape of contact terminal 40 according to Modification 2 of Embodiment 1.

Contact terminal 40 illustrated in FIG. 7 includes button contacting portion 42*a* at the side opposite to contact portion 41 with leaf spring 43 being interposed therebetween. Button contacting portion 42*a* has a U-shape, and it is thus possible to exert the same function as elastic member 70 according to Embodiment 1.

More specifically, button contacting portion 42*a* is capable of suppressing backlash of contact terminal 40 when light-emitting module 20 is not held by holding component 35, and causing contact terminal 40 to operate in such a manner that contact portion 41 moves toward support plate 50, as a result of elastic deformation.

As described above, elastic member 70 is implemented not as a different component but a part of contact terminal 40, thereby making it possible to reduce the number of components included in lighting apparatus 10, and improve production efficiency of lighting apparatus 10, for example.

Modification 3 of Embodiment 1

In Embodiment 1 described above, holding component 35 clamps light-emitting module 20 between contact portion 41 that is a part of contact terminal 40 and support plate 50 disposed at the position opposite to contact portion 41, which allows holder 30 to be temporarily fixed to light-emitting module 20.

However, holding component 35 may clamp light-emitting module 20 without using contact terminal 40, to temporarily fix holder 30 to light-emitting module 20.

Figure 8:
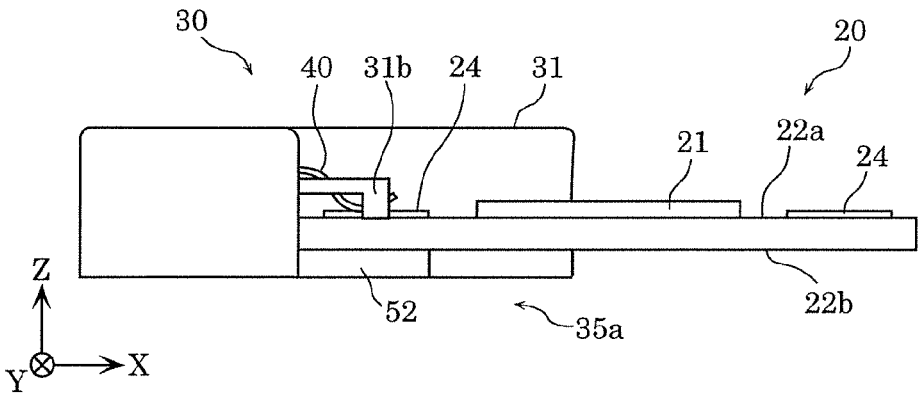
FIG. 8 is a side view illustrating a holder according to Modification 3 of Embodiment 1.

FIG. 8 is a side view illustrating holder 30 according to Modification 3 of Embodiment 1.

Holder 30 according to Modification 3 of Embodiment 1 illustrated in FIG. 8 includes holding component 35*a* which holds light-emitting module 20 in the cantilever-style by clamping a portion of light-emitting module 20 from the side facing back surface 22*b* and from the side facing main surface 22*a*. This is a common feature with holding component 35 according to Embodiment 1 described above.

However, holding component 35*a* according to the present modification has a feature in including: main surface contacting portion 31*b* which comes in contact with main surface 22*a* of light-emitting module 20; and support plate 52 disposed at a position opposite to main surface contacting portion 31*b*.

More specifically, main surface contacting portion 31*b* is, for example, a component which is molded integrally with or attached to main body 31, and includes a material such as resin. In other words, a configuration for sandwiching a part of light-emitting module 20 using a component different from contact terminal 40 is employed in holding component 35*a* according to the present modification.

As described above, according to the present modification, main surface contacting portion 31*b* included in holding component 35*a* is a dedicated component for holding light-emitting module 20.

More specifically, holding component 35*a* is a constituent element of holder 30 which has a function of not electrically connecting holder 30 and light-emitting module 20 but holding light-emitting module 20 in the cantilever-style (temporarily fixing holder 30 to light-emitting module 20).

It is therefore possible to form holding component 35*a* into a shape and size more suitable to hold light-emitting module 20, according to the shape and the like of substrate 22 of light-emitting module 20, for example. It is also possible to select the material of holding component 35*a* from among various materials.

It is to be noted that holder 30 may include holding component 35 according to the above-described Embodiment 1 and holding component 35*a* according to the present modification. This configuration reduces the possibility that holder 30 comes off light-emitting module 20 before holder 30 attached to light-emitting module 20 is attached to base 12.

Embodiment 2

In the above-described Embodiment 1, the stability of mechanical and electrical connection between holder 30 and light-emitting module 20 is improved using the relative movement of holder 30 and light-emitting module 20 at the time of attaching holder 30 to light-emitting module 20.

However, the stability of mechanical and electrical connection between holder 30 and light-emitting module 20 may be improved using other components used in assembling lighting apparatus 10, for example.

For example, holder 30 is fixed to base 12 by being fastened to base 12 with screw 80 as described above. Thus, the stability of mechanical and electrical connection between holder 30 and light-emitting module 20 may be improved using the force resulting from the fastening by screw 80.

In view of the above, holder 130 which improves the stability of the connection using screw 80 will be described in Embodiment 2 with a focus on a difference from the above-described Embodiment 1.

Figure 9:
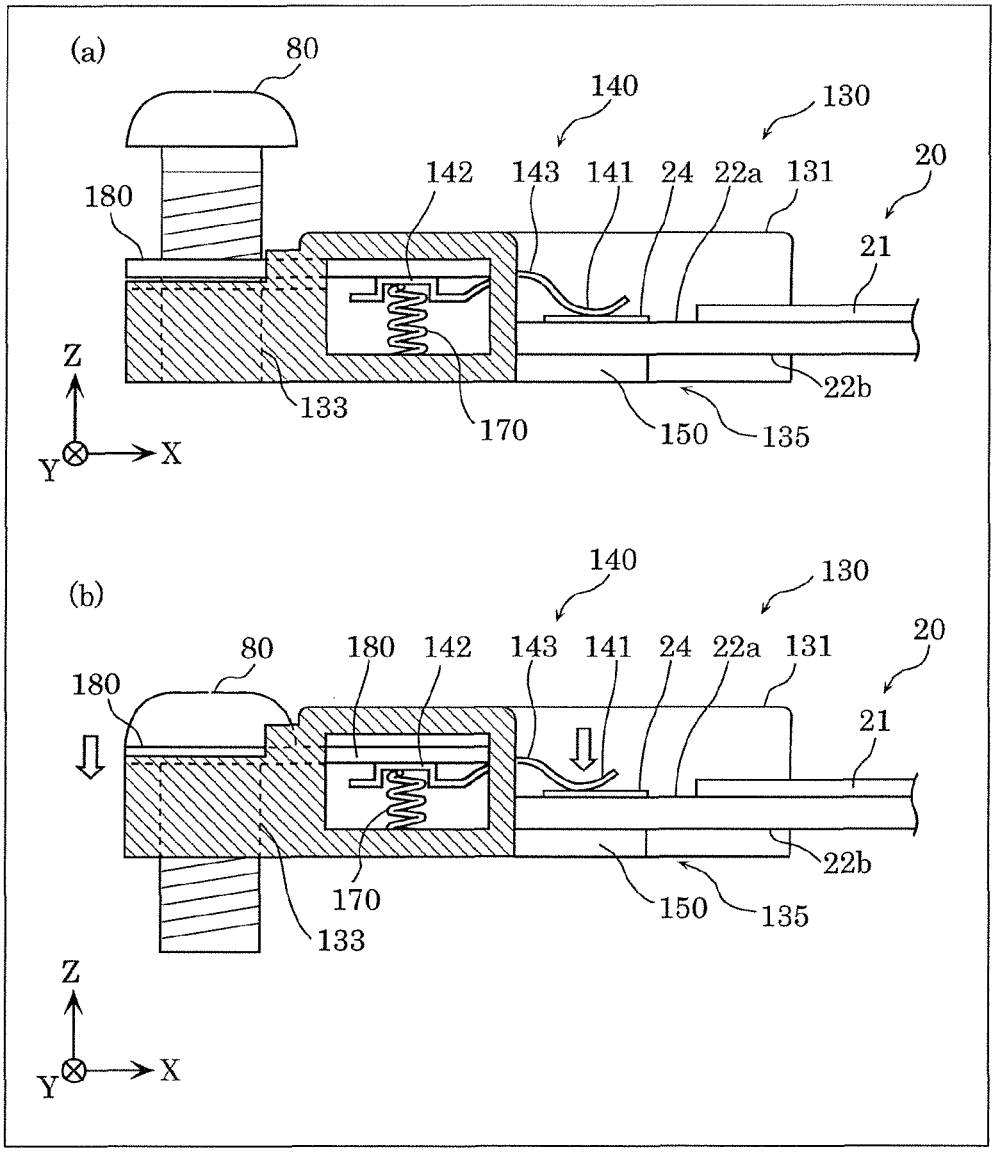
FIG. 9 is a diagram illustrating an operation of the holding component in the holder according to Embodiment 2.

FIG. 9 is a diagram illustrating an operation of holding component 135 in holder 130 according to Embodiment 2.

Figure 10:
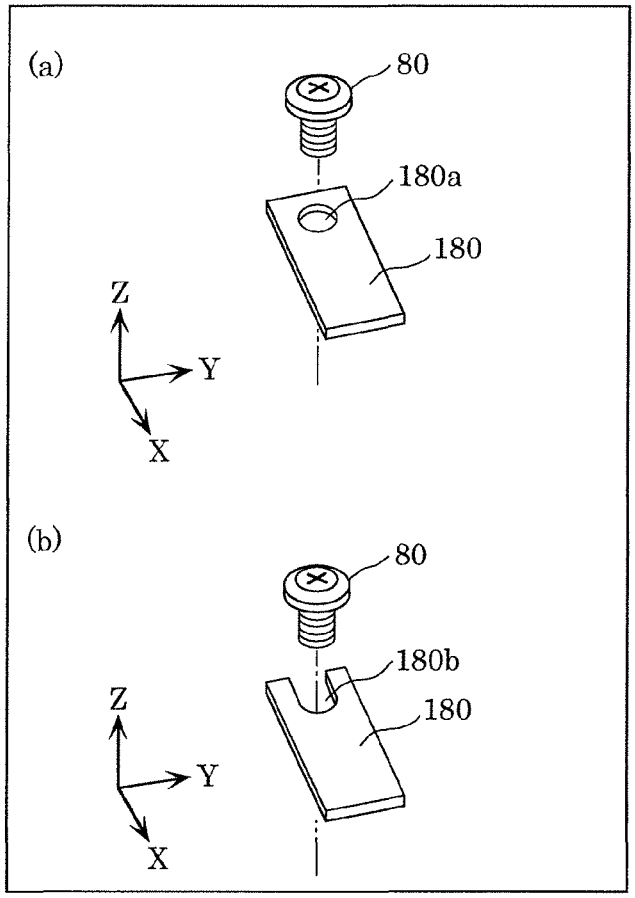
FIG. 10 is diagram illustrating examples of the shape of a movable plate according to Embodiment 2.

FIG. 10 is diagram illustrating examples of the shape of movable plate 180 according to Embodiment 2.

It is to be noted that FIG. 9 illustrates a cross-sectional view of holder 130 according to Embodiment 2, which is taken from plane XZ passing a position in front of contact terminal 40 (the negative side of axis Y) for enabling visually comprehending an operation of holding component 135. In addition, FIG. 9 illustrates a side view of a part of light-emitting module 20. Illustration of the lighting apparatus 10 as a whole and base 12 according to the present exemplary embodiment will be omitted. The above-stated items are also applied to FIG. 11 which will be described later.

Holder 130 illustrated in FIG. 9 is, as with holder 30 according to the above-described Embodiment 1, one of holders 130 each of which supplies power to light-emitting module 20 and fixes light-emitting module 20 to base 12 in lighting apparatus 10.

Holder 130 includes contact terminal 140 and holding component 135. Holding component 135 holds light-emitting module 20 by clamping a portion of light-emitting module 20 in the thickness direction.

More specifically, according to the present exemplary embodiment, holding component 135 includes: contact portion 141 which is a portion of contact terminal 140 to be in contact with electrode 24 of light-emitting module 20; and support plate 150 disposed at a position opposite to contact portion 141. Holding component 135 holds light-emitting module 20 in the cantilever-style between contact portion 141 and support plate 150, by clamping a portion of light-emitting module 20 that is an end portion on which electrode 24 is disposed.

More specifically, holder 130 according to Embodiment 2 has a structural feature common to holder 30 according to the above-described Embodiment 1.

However, holder 130 according to Embodiment 2 is different from holder 30 according to the above-described Embodiment 1 in that contact terminal 140 is operated so that contact portion 41 is moved toward support plate 150 using a force received from screw 80.

More specifically, holder 130 according to Embodiment 2 includes main body 31 on which screw attaching portion 133 through which screw 80 penetrates for fixing holder 130 to base 12. Contact terminal 140 is disposed such that contact portion 141 is moved toward support plate 150 by being subjected to force from screw 80 at the time when holder 130 is fixed to base 12 by screw 80.

In other words, holding strength of holding component 135 is increased using screw 80 necessary for assembling lighting apparatus 10, in Embodiment 2, thereby improving the stability of mechanical and electrical connection between holder 130 and light-emitting module 20

More specifically, holder 130 according to the present exemplary embodiment further includes movable plate 180 which moves as a result of being pressed by screw 80 when holder 130 is fixed to base 12 by screw 80, and contact terminal 140 is subjected to force from screw 80 via movable plate 180.

Movable plate 180 is disposed movably as illustrated in (a) and (b) in FIG. 9.

In addition, through hole 180*a* of a size that allows a shank of screw 80 to penetrate therethrough and does not allow a head of screw 80 to penetrate therethrough is defined in movable plate 180 as illustrated in (a) in FIG. 10, for example. In addition, notch 180*b* of a size that allows the shank of screw 80 to penetrate therethrough and does not allow the head of screw 80 to penetrate therethrough is defined in movable plate 180 as illustrated in (b) in FIG. 10, for example. In other words, movable plate 180 is formed such that the head of screw 80 comes in contact with movable plate 180 as a result of screw 80 moving downward.

In addition, contact terminal 140 includes movable-plate contacting portion 142 defined at the end portion opposite to contact portion 141. Movable-plate contacting portion 142 is biased upward by elastic member (spiral spring, in the present exemplary embodiment) 170 in holder 130, as illustrated in (a) in FIG. 9. Movable plate 180 is held by holder 130 with movable plate 180 being pushed up by elastic member 170 together with movable-plate contacting portion 142.

As illustrated in (b) in FIG. 9, movable-plate contacting portion 142 moves downward against the biasing force of elastic member 170, as a result of the head of screw 80 coming in contact with movable-plate contacting portion 142 of contact terminal 140 in the above-described state.

With this, contact terminal 140 moves downward. In other words, contact terminal 140 causes contact portion 141 to move toward support plate 150.

As a result, suppress strength to electrode 24 of contact portion 141 increases, causing the end portion of light-emitting module 20 at which electrode 24 is disposed is clamped between contact portion 141 and support plate 150.

In other words, the stability of mechanical and electrical connection between holder 30 that holds light-emitting module 20 in the cantilever-style and light-emitting module 20 is improved.

It is to be noted that holder 130, when not fixed to base by screw 80, holds light-emitting module 20 in the cantilever-style by clamping, between contact portion 141 and support plate 150, the end portion of light-emitting module 20 at which electrode 24 is disposed as illustrated in (a) in FIG. 9.

In other words, according to the present exemplary embodiment, holder 130 is temporarily fixed to light-emitting module 20 by the elastic force of at least one of contact terminal 140 and support plate 150.

In addition, two holders 130 are attached (temporarily fixed) to light-emitting module 20 in a one-to-one correspondence with two electrodes 24 of light-emitting module 20, according to the configuration illustrated in (a) in FIG. 9.

More specifically, it is possible to place holders 130 and light-emitting module 20 which are integrated by temporarily fixing holders 130 to light-emitting module 20 at a predetermined position of base 12, and to fix, in the state, each of holders 130 to base 12 using screw 80. In addition, the stability of electrical connection between contact terminal 140 of each of holders 130 and corresponding one of electrodes 24 is maintained by the fixing using screw 80.

Thus, it is possible, with holder 130 according to the present exemplary embodiment, to supply power to light-emitting module 20 and to facilitate the work for fixing light-emitting module 20 to base 12.

In addition, with lighting apparatus 10 according to the present exemplary embodiment, attachment of holder 130 which supplies power to light-emitting module 20 and fixes light-emitting module 20 to base 12 is easily carried out.

It is to be noted that, although screw attaching portion 133 and contact 140 are aligned in the X axis direction in holder 130 according to the present exemplary embodiment as illustrated in FIG. 9, screw attaching portion 133 and contact 140 may be aligned in the Y axis direction, for example.

In other words, it is sufficient that contact terminal 140 is disposed in such a manner that contact portion 141 is moved toward support plate 150 using the force received from screw 80. In sum, it is sufficient that screw attaching portion 133 and contact terminal 140 are disposed at positions where the above-described conditions are satisfied.

It is to be noted that the configuration of holder 130 according to Embodiment 2 may differ from the configuration illustrated in FIG. 9. The following describes, with reference to FIG. 11, a modification example of holder 130, with a focus on a difference from Embodiment 2.

Modification of Embodiment 2

In Embodiment 2 described above, elastic member 170 that is involved in an operation of movable contact terminal 140 is a spiral spring. However, elastic member 170 may be a spring of other types, a rubber elastic body, etc.

In addition, a part of contact terminal 140 may serve as elastic member 170.

Figure 11:
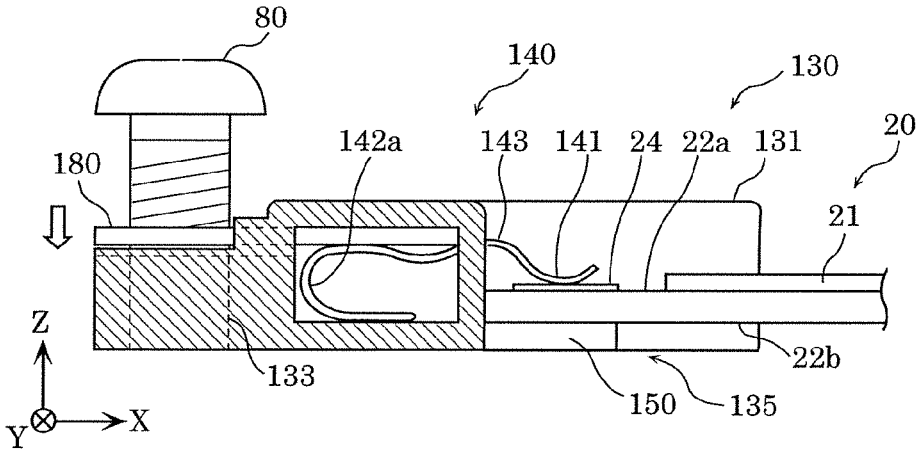
FIG. 11 is a side view illustrating a shape of a contact terminal according to a modification of Embodiment 2.

FIG. 11 is a side view illustrating a shape of contact terminal 140 according to Modification of Embodiment 2.

Contact terminal 140 illustrated in FIG. 11 includes movable-plate contacting portion 142*a* which is defined at the side opposite to contact portion 141 with leaf spring 143 disposed in between, and has a U-shape, thereby exerting the same function as elastic member 170 according to Embodiment 2.

More specifically, movable-plate contacting portion 142*a* is capable of suppressing backlash of contact terminal 140 when light-emitting module 20 is not held by holding component 135, and causing contact terminal 140 to operate so that contact portion 141 moves toward support plate 50, as a result of elastic deformation.

As described above, elastic member 170 is implemented not as a different component but a part of contact terminal 140, thereby making it possible to reduce the number of components included in lighting apparatus 10, and improve production efficiency of lighting apparatus 10, for example.

Embodiment 3

In an LED lighting apparatus in which power for light emission is supplied to an LED module via a holder, it is preferable that the holder is compact or thin so as to avoid shading the distribution of light from the LED module or causing interference with other components, for example. Meanwhile, holder requires a space for connection with an external power line. Furthermore, in consideration of efficiency in assembly work, a configuration which allows easy connection with the external power line is required.

In view of the above-described conventional problems, an object of the present exemplary embodiment is to provide: a holder which is for fixing a light-emitting module to a base, and allows easy connection with an external power line; and a lighting apparatus including the holder.

A holder according to an aspect of the present disclosure is a holder for fixing a light-emitting module to be placed on a placement face of a base to the base, which includes: a contact terminal to be electrically connected to the light-emitting module; and a main body on which the contact terminal is disposed. The main body includes a power-line housing for housing the external power line to be electrically connected to the contact terminal, which houses the power line with at least a part of the power line that is inserted into the main body intersecting with a plane parallel to the placement face of the base.

A lighting apparatus according to an aspect of the present disclosure includes: a base; a light-emitting module to be placed on a placement face of the base; and a holder for fixing the light-emitting module to the base, wherein the holder includes: a contact terminal to be electrically connected to the light-emitting module; and a main body on which the contact terminal is disposed, and the main body includes a power-line housing for housing an external power line with at least a part of the external power line that is inserted into the main body intersecting with a plane parallel to the placement face of the base, the external power line being to be electrically connected to the contact terminal.

With the holder according to an aspect of the present disclosure, it is possible to fix the light-emitting module to the base, and connection with an external power line is easily carried out.

In addition, with the lighting apparatus according to an aspect of the present disclosure, it is easy to connect the external power line to the holder for fixing the light-emitting module to the base.

A lighting apparatus according to Embodiment 3 will be described below with reference to each of the drawings.

Figure 12:
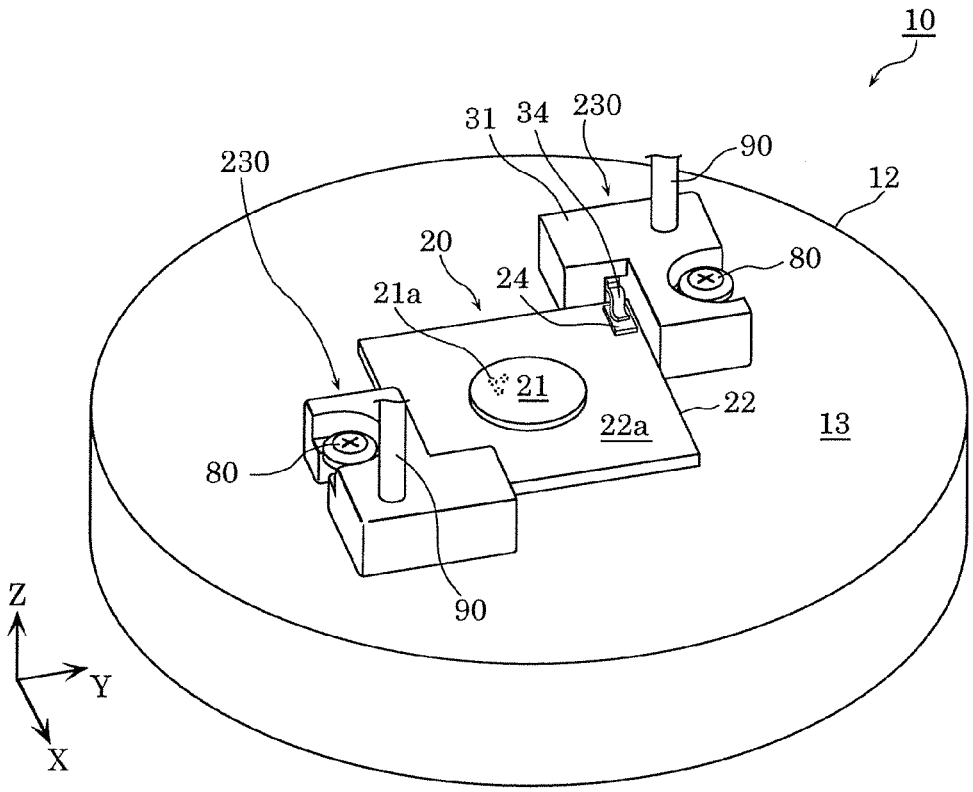
FIG. 12 is a perspective view illustrating a basic configuration of a lighting apparatus according to Embodiment 3.
Figure 13:
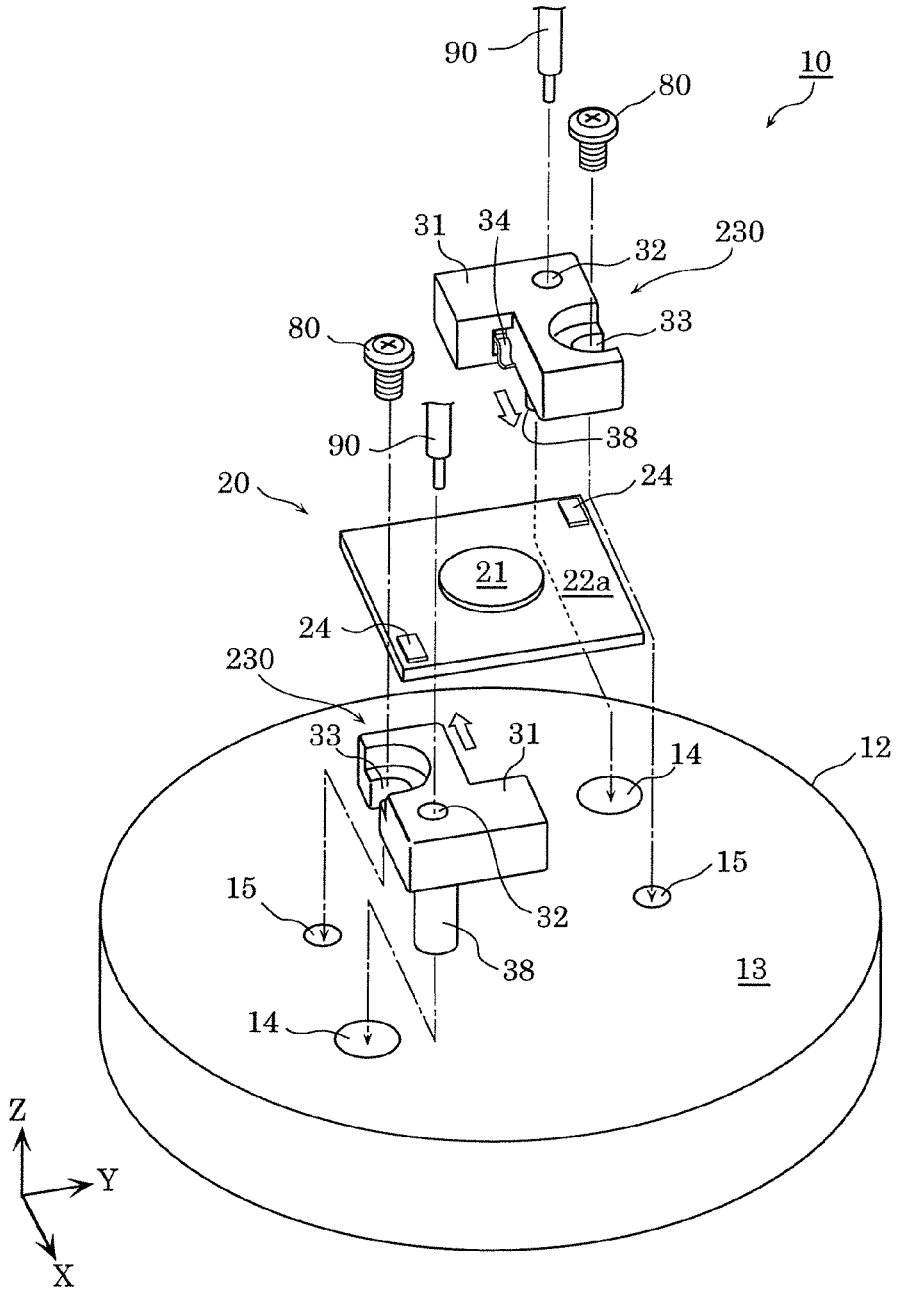
FIG. 13 is an exploded perspective view corresponding to FIG. 12.

First, the following describes an overview of a configuration of a lighting apparatus according to Embodiment 3, with reference to FIG. 12 and FIG. 13.

FIG. 12 is a perspective view illustrating a basic configuration of lighting apparatus 10 according to Embodiment 3.

FIG. 13 is an exploded perspective view corresponding to FIG. 12.

As illustrated in FIG. 12 and FIG. 13, lighting apparatus 10 according to Embodiment 3 includes: base 12; light-emitting module 20 to be placed on placement face 13 of base 12; and holder 230 for fixing light-emitting module 20 to base 12.

It is to be noted that lighting apparatus 10 may include other components such as a transparent cover disposed to cover light-emitting module 20, other than the components illustrated in FIG. 12 and FIG. 13, and the number of light-emitting modules 20 is not limited, as with the above-described Embodiment 1.

In addition, lighting apparatus 10 according to the present exemplary embodiment is a lighting apparatus used as, for example, a so-called downlight which is recessed in the ceiling with light-emitting module 20 facing downward, as with the above-described Embodiment 1.

In addition, elements such as substrate 22 and light emitter 21 included in light-emitting module 20 are common with those in the above-described Embodiment 1.

According to the present exemplary embodiment, an outer diameter of light emitter 21 is, for example, 5 mm to 50 mm. In the case where lighting apparatus 10 is a 20 W LED lamp, the outer diameter of light emitter 21 is, for example, 15 mm.

It is to be noted that an overall shape of light emitter 21 is not limited to the round shape, how to seal LED chips 21*a* using the sealing component is not limited, and one or more LED chips 21*a* are not necessarily sealed by the sealing component, as with the above-described Embodiment 1.

Furthermore, a pair of electrodes 24 are disposed on main surface 22*a* of substrate 22. Each of LED chips 21*a* included in light emitter 21 is supplied with power for light emission, via a wiring pattern (not illustrated) connected to the pair of electrodes 24.

Light emitting module 20 including LED chips 21*a* as a light source as described above is fixed to base 12.

Base 12 is a metal base shaped like a columnar pedestal in the present exemplary embodiment, and when light-emitting module 20 is placed in surface-to-surface contact with placement face 13 of base 12, it is possible to effectively release heat generated in light-emitting module 20. In other words, base 12 is a component which functions as a heat sink for diffusing heat of light-emitting module 20.

It is to be noted that the shape of base 12 is not limited to the columnar pedestal, and may be a cuboid, for example. In addition, base 12 may have a wall surrounding a region in which light-emitting module 20 is to be placed.

Light-emitting module 20 is fixed to base 12 by two holders 230. According to the present exemplary embodiment, two holders 230 are disposed so as to hold two portions which are positioned diagonally in light-emitting module 20 having a rectangle shape.

Two holders 230 are equivalent components in the present exemplary embodiment, and thus it is possible, for example, to exchange holder 230 on the right with holder 230 on the left in the arrangement illustrated in FIG. 12. In other words, a feature of holder 230 described below is applied to both of two holders 230 included in lighting apparatus 10.

Holder 230 includes: contact terminal 34 to which light-emitting module 20 is electrically connected; and main body 31 on which contact terminal 34 is disposed.

Main body 31 includes power-line housing 38 for housing external power line 90 to be electrically connected to contact terminal 34. Power-line housing 38 houses power line 90 with at least a part of power line 90 that is inserted into main body 31 intersecting with a plane parallel to placement face 13 of base 12.

It is to be noted that power line 90 is connected to a lighting apparatus disposed on a back side of a ceiling, for example, and pulled out to the side faced by placement face 13 of base 12 through an opening (not illustrated) defined in base 12 or an opening defined in a vicinity of the position at which base 12 is recessed in the ceiling, for example. The lighting apparatus is an apparatus for converting commercial power supply, for example, to power having characteristics suitable to light emission of light-emitting module 20.

Main body 31 is manufactured by, for example, molding synthetic resin having insulation properties, such as PBT (polybutylene terephthalate).

Main body 31 includes screw attaching portion 33 through which screw 80 penetrates as illustrated in FIG. 13. Threaded hole 15 into which screw 80 is screwed is defined in placement face 13 of base 12.

Holder 230 is attached to base 12 from above light-emitting module 20 which is in surface-to-surface contact with placement face 13 of base 12. More specifically, holder 230 is fixed to base 12 by screw 80 penetrating through screw attaching portion 33, with contact terminal 34 being in contact with electrode 24 of light-emitting module 20.

With this configuration, light-emitting module 20 and base 12 are fixed, thereby mechanically and thermally connecting light-emitting module 20 and base 12. More specifically, contact terminal 34 is pressed to electrode 24, thereby electrically connecting holder 230 and light-emitting module 20.

It is to be noted that, according to the present exemplary embodiment, a pair of holders 230 presses light-emitting module 20 toward base 12, thereby fixing light-emitting module 20 to base 12.

With holder 230 according to the present exemplary embodiment, it is possible to fix light-emitting module 20 to base 12 with holder 230 and light-emitting module 20 being electrically connected.

Holder 230 further includes power-line housing 38 which houses external power line 90, and is capable of supplying power supplied from power line 90 housed by power-line housing 38 to light-emitting module 20 via contact terminal 34.

More specifically, main body 31 of holder 230 includes insertion opening 32 into which power line 90 is inserted. According to the present exemplary embodiment, insertion opening 32 is defined in a surface of main body 31 positioned opposite to base 12. More specifically, with holder 230 according to the present exemplary embodiment, it is possible to insert power line 90 vertically with respect to holder 230 (with respect to placement face 13 of base 12) as illustrated in FIG. 12 and FIG. 13, and power line 90 inserted is housed in power-line housing 38.

It is to be noted that, housing (inserting) power line 90 means that a part of power line 90 including an end portion is housed (inserted).

In addition, recess portion 14 into which power-line housing 38 of holder 230 is to be inserted is defined in base 12.

Here, with a conventional lighting apparatus which fixes a light-emitting module to a base using a holding member such as a holder, when power is supplied to the light-emitting module via the holding member, an external power line is inserted from a lateral side with respect to the holding member.

More specifically, the power line is inserted into the holding member in a direction parallel to a surface of the base on which the light-emitting module is to be placed, and the power line inserted into the holding member is housed in a direction parallel to the surface. In this case, the thickness of the holding member (height from the surface on which the light-emitting module is to be placed) is less influenced by the length of the portion of the power line inserted into the holding member, while the difficulty arises in the assembly.

More specifically, there is a problem that it is difficult to insert a power line into a holding member when there is another component in a vicinity of a position at which the light-emitting module is to be placed on the base, such as a wall portion disposed to surround the light-emitting module, or other light-emitting module. In other words, a space which enables holding the power line with fingers and inserting the power line into the holding member is necessary in the vicinity of the holding member in a plan view.

In addition, when fixing the light-emitting module to the base with the power line being inserted in advance, there is a problem that, for example, the power line is likely to come off the holding member, or it is difficult to align the holding member with respect to the base, due to low flexibility of the power line or the like.

Furthermore, in order to wire a power line having low flexibility without generating excessive stress, that is, without bending the power line, it is necessary to provide a space through which the power line passes in the vicinity of the holding member in a plan view.

In view of the above, with holder 230 included in lighting apparatus 10 according to the present exemplary embodiment, power line 90 is housed with at least a part of power line 90 intersecting with a plane that is parallel to placement face 13. With this configuration, inserting power line 90 into holder 230 is easily carried out, while making it possible to downsize or reduce the thickness of holder 230.

Figure 14:
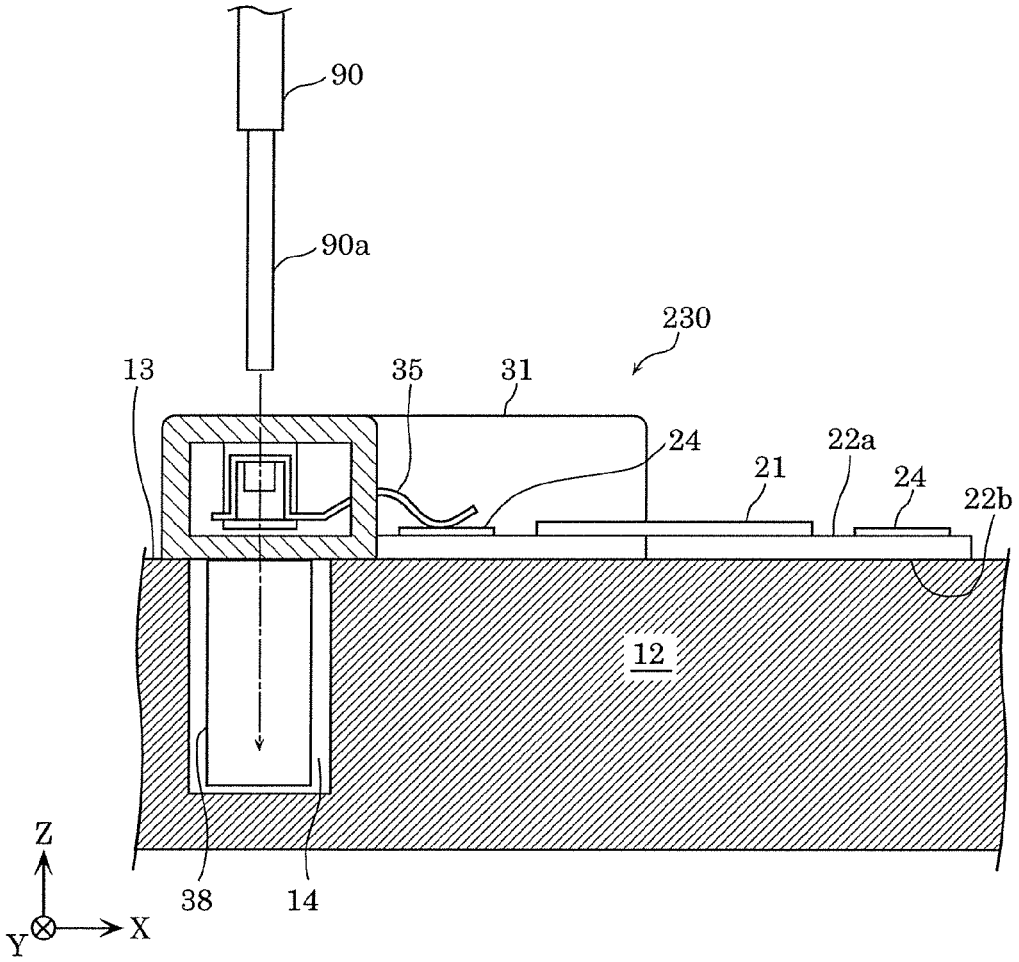
FIG. 14 is a side view illustrating an overview of an inside of a holder according to Embodiment 3.
Figure 15:
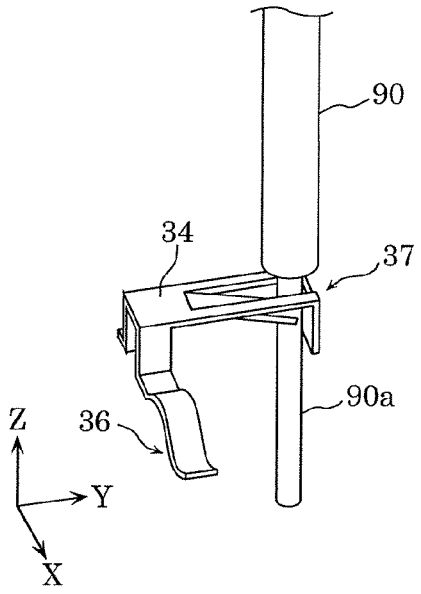
FIG. 15 is a perspective view illustrating an external view of a contact terminal according to Embodiment 3.
Figure 16:
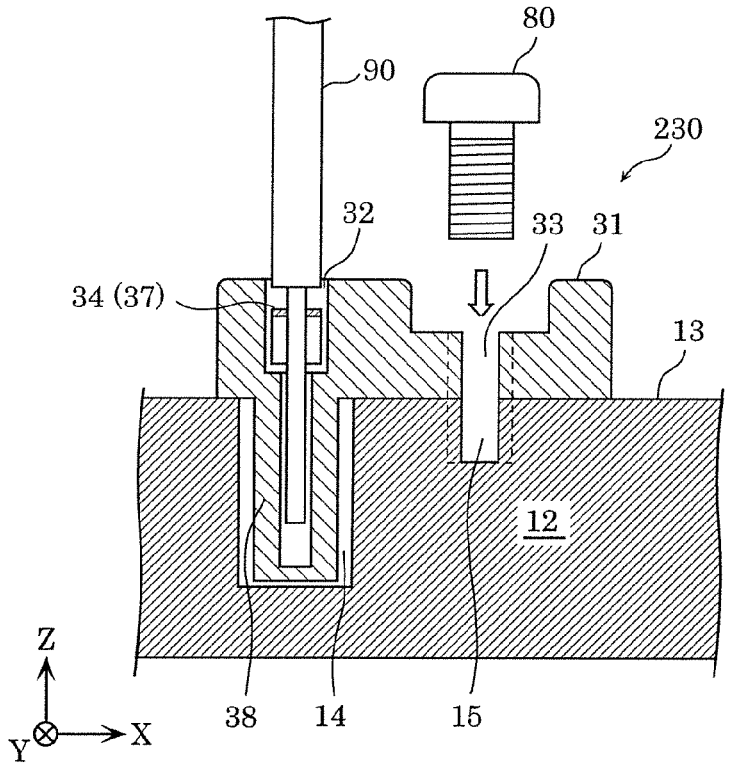
FIG. 16 is a side view illustrating an overview of an inside of a holder according to Embodiment 3.

The following describes holder 230 that has the above-described feature, with reference to FIG. 14 to FIG. 16.

FIG. 14 is a side view illustrating an overview of an inside of holder 230 according to Embodiment 3.

FIG. 15 is a perspective view illustrating an external view of contact terminal 34 according to Embodiment 3.

FIG. 16 is a cross-sectional view illustrating an overview of the inside of holder 230 according to Embodiment 3.

It is to be noted that FIG. 14 illustrates a cross-sectional view of holder 230 which is taken from plane XZ passing a position on the left of contact terminal 34 of holder 230 disposed on the right in FIG. 12. In addition, FIG. 14 illustrates a cross-sectional view of base 12 which is taken from plane XZ passing a position of recess portion 14 into which power-line housing 38 is inserted, for facilitating understanding of the structural feature. In addition, light-emitting module 20 is illustrated in a side view.

Furthermore, FIG. 16 illustrates a cross-sectional view of holder 230 and base 12 which is taken from plane XZ passing a position of power-line housing 38.

As illustrated in FIG. 14 and FIG. 16, light-emitting module 20 is placed on placement face 13 of base 12. More specifically, light-emitting module 20 is placed with back surface 22*b* of substrate 22 being in surface-to-surface contact with placement face 13 of base 12. Holder 230 fixes, to base 12, light-emitting module 20 that is placed as above.

In addition, power-line housing 38 included in holder 230 houses power line 90 in such a manner that at least a part of power line 90 inserted into main body 31 intersects with a plane (plane XY in the present exemplary embodiment) parallel to placement face 13 of base 12.

More specifically, power line 90 inserted into main body 31 is entirely housed by power-line housing 38 in such a manner that power line 90 orthogonally or approximately orthogonally intersects with a plane parallel to placement face 13, according to the present exemplary embodiment.

Power line 90 housed by power-line housing 38 in such a state as described above is connected to contact terminal 34 disposed in main body 31.

More specifically, contact terminal 34 includes contact portion 36 and power-line connecting portion 37, as illustrated in FIG. 15. Contact portion 36 is a portion which contacts with electrode 24 of light-emitting module 20. When light-emitting module 20 is fixed to base 12 by holder 230, contact portion 36 is pressed to electrode 24 of light-emitting module 20 by the elastic force of contact terminal 34.

In addition, power-line connecting portion 37 is a portion which connects with power line 90. More specifically, power-line connecting portion 37 is a part of contact terminal 34, and a portion formed such that, when an end portion of power line 90 which is not covered by a insulation coating (core line portion 90*a*) is inserted, the end portion does not easily come off. For example, power-line connecting portion 37 is formed by cutting and raising a part of power-line connecting portion 37 that is molded from metal plate. It is to be noted that core line portion 90*a* is provided by removing the insulation coating at the end portion of power line 90 by approximately 8 mm to 10 mm.

As described above, power line 90 mechanically and electrically connected to contact terminal 34 is housed straight by power-line housing 38 as illustrated in FIG. 16, according to the present exemplary embodiment.

Power-line housing 38 has a protruding shape that protrudes toward base 12 from main body 31, for housing power line 90 in the above-described state. Corresponding to the above-described shape, base 12 includes recess portion 14 into which power-line housing 38 is inserted, as illustrated in FIG. 14 and FIG. 16.

As described above, lighting apparatus 10 according to the present exemplary embodiment includes holder 230 for fixing, to base 12, light-emitting module 20 which is placed on placement face 13 of base 12.

Holder 230 includes: contact terminal 34 to which light-emitting module 20 is electrically connected; and main body 31 on which contact terminal 34 is disposed. Main body 31 includes power-line housing 38 for housing external power line 90 electrically connected to contact terminal 34.

Power-line housing 38 houses power line 90 in such a manner that at least a part of power line 90 inserted into main body 31 intersects with a plane parallel to placement face 13 of base 12.

Holder 230 according to the present exemplary embodiment has the above-described configuration, thereby facilitating inserting of power line 90 into holder 230 after attaching holder 230 to base 12.

For example, even when there is a component (other components) other than light-emitting module 20 fixed by holder 230 in the vicinity of holder 230 in a plan view, it is possible to easily insert power line 90 into holder 230 without obstacle of the other component.

In addition, the direction of force at the time of inserting power line 90 into holder 230 is the same as the direction of pressing holder 230 to base 12. For that reason, it is possible to, for example, insert power line 90 into holder easily and stably.

In addition, the space for wiring power line 90 in the vicinity of holder 230 in a plan view is not required, and thus it is possible to reduce the size of base 12 in a plan view, for example. Moreover, it is possible, for example, to dispose other components such as a reflector in a vicinity of light-emitting module 20 and holder 230.

In addition, the size of holder 230 in a plan view is less influenced by the length of the inserted portion of power line 90 into holder 230, and thus it is possible to relatively reduce the size of holder 230 in a plan view.

Furthermore, according to the present exemplary embodiment, power-line housing 38 has a protruding shape that protrudes toward base 12 when holder 230 is attached to base 12. In addition, base 12 includes recess portion 14 defined on placement face 13 and into which power-line housing 38 is inserted. More specifically, a portion protruding from main body 31 of power-line housing 38 is inserted into recess portion 14 of base 12.

For that reason, the thickness of holder 230 (the height from placement face 13 when holder 230 is attached to base 12) is less influenced by the length of the inserted portion of power line 90 into holder 230. With this configuration, it is possible to relatively thinly form holder 230.

Thus, the amount of light emitted from light-emitting module 20 being blocked by holder 230 is suppressed. In other words, lighting apparatus 10 is capable of effectively emitting illumination light of light-emitting module 20 to the outside.

As described above, holder 230 according to the present exemplary embodiment is for fixing light-emitting module 20 to base 12, and facilitates connection of external power line 90.

In addition, lighting apparatus 10 according to the present exemplary embodiment facilitates connection of external power line 90 to holder 230 for fixing light-emitting module 20 to base 12.

These features are useful for lighting apparatus 10 in which one light-emitting module 20 is fixed by a plurality of holders 230 as with the present exemplary embodiment, from the perspective of, for example, improving efficiency in assembly work of lighting apparatus 10.

In addition, power-line housing 38 is inserted into base 12, thereby allowing restriction on movement in the direction parallel to placement face 13 of holder 230.

More specifically, since power-line housing 38 is used for determining a position of holder 230 with respect to base 12, it is possible to effectively advance assembly work of lighting apparatus 10.

In addition, power-line housing 38 is circular in cross-section across a protruding direction (a direction of axis Z in the present exemplary embodiment) of power-line housing 38. Thus, recess portion 14 having a shape corresponding to power-line housing 38 is easily defined on base 12, for example.

In addition, when a plurality of threaded holes 15 each corresponding to one recess portion 14 are defined on placement face 13, it is possible to change a rotation position of holder 230 on placement face 13.

Moreover, holder 230 according to the present exemplary embodiment is disposed to fix light-emitting module 20 at a corner of light-emitting module 20 as illustrated in FIG. 12 etc. For that reason, even when there is a change in the size of light-emitting module 20 to be fixed, it is possible to use holder 230 as a component for fixing light-emitting module 20 of a size that has been changed, unless a problem arises in conduction between contact terminal 34 and electrode 24.

In other words, it is possible to assemble a plurality of lighting apparatuses 10 each including light-emitting module 20 of a different size, by preparing a plurality of holders 230 of the same type.

In addition, the configuration of holder 230 according to Embodiment 3 may differ from the configurations illustrated in FIG. 12 to FIG. 16. The following describes various modifications of holder 230, with a focus on a difference from Embodiment 3, with reference to FIG. 17 to FIG. 20.

It is to be noted that the holder according to each of the modifications described below is a holder which can be employed as a component for fixing light-emitting module 20 to base 12 in lighting apparatus 10 according to Embodiment 3.

Modification 1 of Embodiment 3

Figure 17:
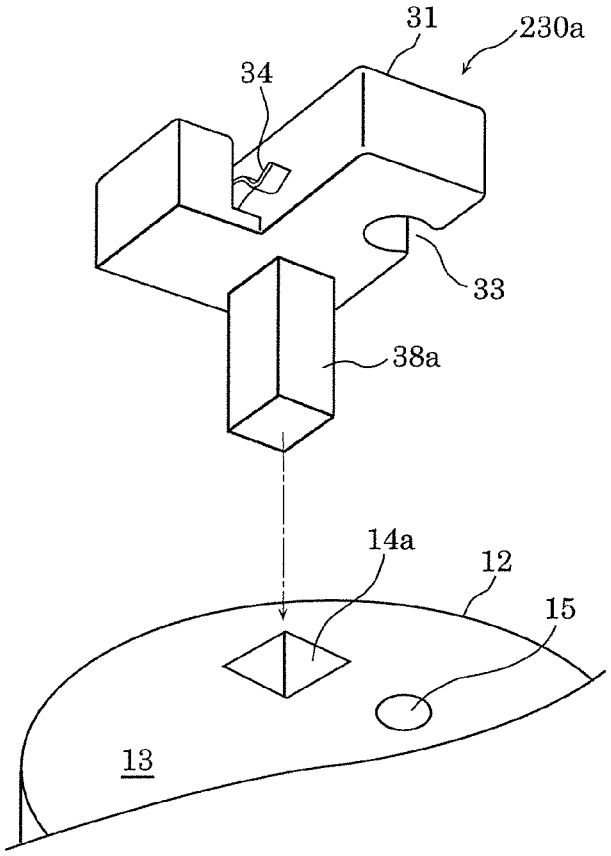
FIG. 17 is a perspective view illustrating an external view of a holder according to Modification 1 of Embodiment 3.

FIG. 17 is a perspective view illustrating an external view of holder 230*a* according to Modification 1 of Embodiment 3.

Holder 230*a* illustrated in FIG. 17 includes power-line housing 38*a* disposed on main body 31. Power-line housing 38*a* houses power line 90 in such a manner that at least a part of power line 90 inserted into main body 31 intersects with a plane parallel to placement face 13 of base 12. For that reason, power line 90 is easily inserted into holder 230*a* according to the present modification.

In addition, power-line housing 38*a* according to the present modification has a feature that power-line housing 38*a* is polygonal in cross-section across a protruding direction (the direction of axis Z in the present modification) of power-line housing 38*a*.

In addition, according to the present modification, recess portion 14*a* having a cross-sectional shape (polygonal shape) corresponding to the outer shape of power-line housing 38*a* is defined as illustrated in FIG. 17. In other words, according to the present modification, when power-line housing 38*a* of holder 230*a* is inserted into recess portion 14*a* of base 12, it is substantially impossible for power-line housing 38*a* to rotate in recess portion 14*a*. With this configuration, the rotation position of holder 230*a* on placement face 13 is restricted.

For that reason, when attaching holder 230*a* to base 12 using screw 80, for example, alignment of screw attaching portion 33 of holder 230*a* and threaded hole 15 of base 12 is easily carried out.

With this configuration, the efficiency in assembling work of lighting apparatus 10 when fixing one light-emitting module 20 by a plurality of holders 230*a* is improved.

Modification 2 of Embodiment 3

Figure 18:
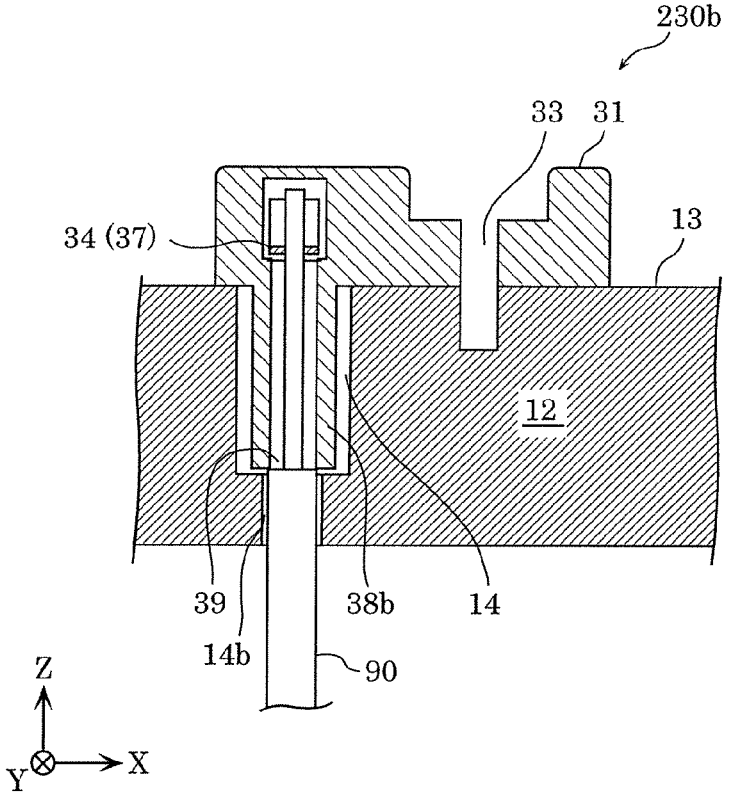
FIG. 18 is a cross-sectional view of a holder according to Modification 2 of Embodiment 3.

FIG. 18 is a cross-sectional view of holder 230*b* according to Modification 2 of Embodiment 3.

More specifically, FIG. 18 illustrates a cross-sectional view of holder 230*b* and base 12 which is taken from plane XZ passing a position of power-line housing 38*b* as with the above-described FIG. 16.

Holder 230*b* illustrated in FIG. 18 includes power-line housing 38*b* disposed on main body 31. Power-line housing 38*b* houses power line 90 in such a manner that at least a part of power line 90 inserted into main body 31 intersects with a plane parallel to placement face 13 of base 12. For that reason, holder 230*b* according to the present modification facilitates connection of external power line 90.

In addition, power-line housing 38*b* has a feature in that opening 39 is defined on a side facing base 12 when holder 230*b* is attached to base 12, and opening 39 allows electrical line 90 to be inserted.

In addition, according to the present modification, recess portion 14 of base 12 on which holder 230*b* is attached includes through hole 14*b* into which power line 90 is inserted from a surface on the side opposite to placement face 13 on base 12.

More specifically, according to the present modification, power line 90 is inserted into power-line housing 38*b* of holder 230*b* from the side opposite to main body 31, and inserted power line 90 is connected to contact terminal 34.

For example, in the state where an end portion of power line 90 is pulled out to the side facing placement face 13 from recess portion 14, the end portion is inserted into power-line housing 38*b* from opening 39. In this state, holder 230*b* is pressed to placement face 13 of base 12 and attached to base 12 by screw 80. Holder 230*b* is moved in a direction opposite to the direction in which power line 90 is inserted in this process, and thus coming off of power line 90 from holder 230*b* is suppressed.

More specifically, with holder 230*b* according to the present modification, even when power line 90 is inserted prior to attaching holder 230*b* to base 12, a problem such as coming off of power line 90 at the time of attachment to base 12 does not arise.

Thus, holder 230*b* according to the present modification is for fixing light-emitting module 20 to base 12, and facilitates connection of external power line 90.

In addition, it is possible to supply power to light-emitting module 20 via power line 90 without wiring power line 90 on the side facing placement face 13 of base 12.

With this configuration, it is possible to eliminate the influence of power line 90 on illumination light emitted from light-emitting module 20, for example. For that reason, when arranging a plurality of light-emitting modules 20 in juxtaposition on placement face 13 of base 12, the degree of freedom in the arrangement and layout of light-emitting modules 20 increase.

Figure 19:
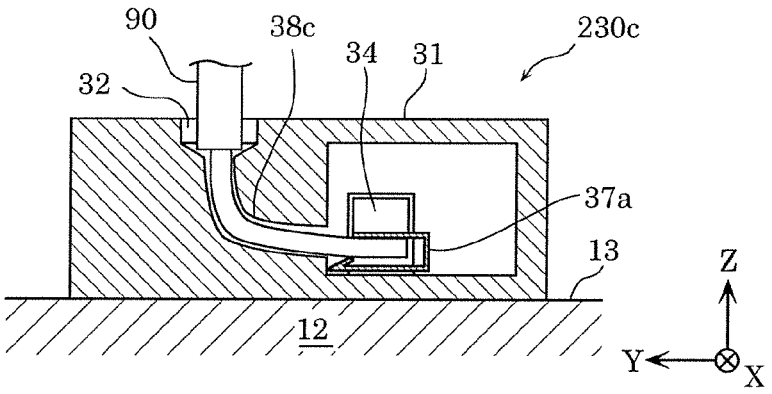
FIG. 19 is a cross-sectional view of a holder according to Modification 3 of Embodiment 3.

Modification 3 of Embodiment 3 FIG. 19 is a cross-sectional view of holder 230*c* according to Modification 3 of Embodiment 3.

More specifically, FIG. 19 illustrates a cross-sectional view of holder 230*c* which is taken from the plane YZ passing a position of power-line housing 38*c*.

Holder 230*c* illustrated in FIG. 19 includes power-line housing 38*c* disposed on main body 31. Unlike power-line housing 38 according to the above-described Embodiment 3, power-line housing 38*c* does not protrude from main body 31 and is formed only inside main body 31.

Power-line housing 38*c* according to such an aspect has a feature in that power line 90 is housed in such a manner that at least a part of power line 90 is bent between insertion opening 32 and power-line connecting portion 37*a* that is a portion of contact terminal 34 at which power line 90 is connected.

In other words, power-line housing 38*c* according to the present modification ensures easiness of inserting power line 90 to holder 230*c* by housing power line 90 in such a manner that at least a part of power line 90 inserted into main body 31 intersects with a plane parallel to placement face 13 of base 12.

In addition, power-line housing 38*c* houses power line 90 in such a manner that at least a part of power line 90 is bent, making it possible that the size of holder 230*c* is less influenced by the length of power line 90 inserted into main body 31.

As described above, external power line 90 is easily connected to holder 230*c* according to the present modification.

In addition, since power-line housing 38*c* does not protrude from main body 31, it is possible, for example, to fix light-emitting module 20 to an existing base having no recess portion 14, using holder 230*c*.

Modification 4 of Embodiment 3

Figure 20:
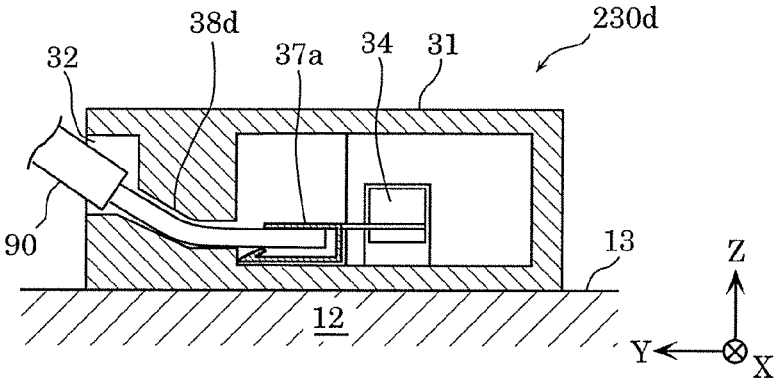
FIG. 20 is a cross-sectional view of a holder according to Modification 4 of Embodiment 3.

FIG. 20 is a cross-sectional view of holder 230*d* according to Modification 4 of Embodiment 3.

More specifically, FIG. 20 illustrates a cross-sectional view of holder 230*d* which is taken from the plane YZ passing a position of power-line housing 38*d*.

Holder 230*d* illustrated in FIG. 20 includes power-line housing 38*d* disposed on main body 31. As with power-line housing 38*c* according to the above-described Modification 3, power-line housing 38*d* does not protrude from main body 31 and is formed only inside main body 31.

Power-line housing 38*d* according to the present modification has a feature that power line 90 is housed in such a manner that at least a part of power line 90 is bent between insertion opening 32 defined on the side surface of main body 31 and power-line connecting portion 37*a*.

In other words, power-line housing 38*d* according to the present modification ensures easiness of inserting power line 90 to holder 230*d* by housing power line 90 in such a manner that at least a part of power line 90 inserted into main body 31 intersects with a plane parallel to placement face 13 of base 12.

More specifically, power line 90 is inserted into holder 230*d* according to the present modification in the direction from oblique upward with respect to placement face 13 in FIG. 20. In other words, compared to the case where power line 90 is inserted into holder 230*d* in the direction parallel to placement face 13, there is less possibility that, for example, inserting power line 90 is made difficult by other components disposed in the vicinity of holder 230*d*.

In addition, power-line housing 38*d* houses power line 90 in such a manner that at least a part of power line 90 is bent, making it possible that the size of holder 230*d* is less influenced by the length of power line 90 inserted into main body 31.

As described above, holder 230*d* according to the present modification facilitates connection of external power line 90.

In addition, since power-line housing 38*d* does not protrude from main body 31, it is possible, for example, to fix light-emitting module 20 to an existing base having no recess portion 14, using holder 230*d*.

Other Embodiments

The lighting apparatus according to the present disclosure has been described based on the above-described exemplary embodiments and modifications. However, the present disclosure is not limited to the above-described exemplary embodiments and modifications.

For example, the holder may include the holding component according to the above-described Embodiment 1 and the power-line housing according to Embodiment 3.

Figure 21:
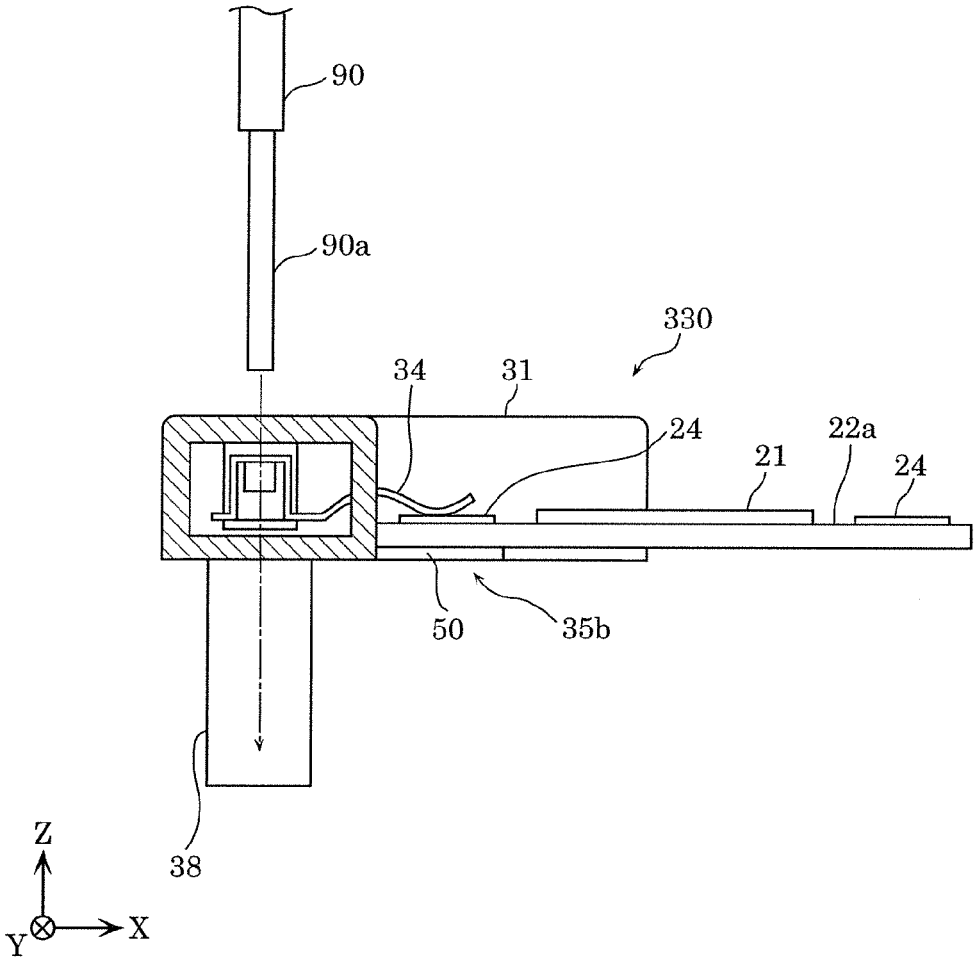
FIG. 21 is a side view illustrating an overview of an inside of a holder that includes a holding component and a power-line housing.

FIG. 21 is a side view illustrating an overview of the inside of holder 330 that includes holding component 35*b* and power-line housing 38. It is to be noted that FIG. 21 illustrates a cross-sectional view of holder 330 which is taken from plane XZ passing a position in front of contact terminal 34 of holder 330. In addition, illustration of base 12 is omitted, and a side view of light-emitting module 20 is illustrated.

Holder 330 illustrated in FIG. 21 includes: contact terminal 34 electrically connected to light-emitting module 20; and holding component 35*b* which holds light-emitting module 20 in a cantilever-style when holder 30 is unattached to base 12. Holding component 35*b* holds light-emitting module 20 by clamping a portion of light-emitting module 20 between contact terminal 34 and support plate 50.

Holder 330 further includes power-line housing 38 disposed on main body 31. Power-line housing houses external power line 90 electrically connected to contact terminal 34. In addition, power-line housing 38 is capable of housing power line 90 in such a manner that at least a part of power line 90 inserted into main body 31 intersects with a plane parallel to placement face 13 (see, for example, FIG. 12) of base 12.

With holder 330 having the above-described configuration, it is possible to supply power to light-emitting module 20 and to facilitate the work for fixing light-emitting module 20 to base 12. In addition, with holder 330, it is possible to fix light-emitting module 20 to base 12, and to facilitate connection of external power line 90.

It is to be noted that holder 330 may include, in place of holding component 35*b*, a holding component having a configuration different from a configuration illustrated in FIG. 21, such as holding component 35 illustrated in FIG. 5, holding component 35*a* illustrated in FIG. 8, and holding component 135 illustrated in FIG. 9, for example. In addition, holder 330 may include, in place of power-line housing 38, a power-line housing having a configuration different from a configuration illustrated in FIG. 21, such as any one of power-line housings 38*a* to 38*d* illustrated in FIG. 17 to FIG. 20, for example.

In addition, light-emitting module 20 is fixed to base 12 by two holders 30 according to the above-described Embodiment 1, for example. However, the number of holders 30 for use in fixing of light-emitting module 20 to base 12 is not limited.

For example, when fixing light-emitting module 20 which is relatively small in size, the number of holders 30 may be one. In this case, electrode 24 (see FIG. 2, for example) which is not electrically connected to holder 30 may be supplied with power from a component different from holder 30. In addition, in this case, fixing force for stably fixing light-emitting module 20 to base 12 may be obtained from the component and holder 30.

In addition, when fixing light-emitting module 20 which is relatively large in size or weight, for example, three or more holders 30 may be used. For example, holder 30 may be disposed at each of four corner portions of light-emitting module 20 which is shaped in rectangle in a plan view. In this case, each of at least two holders 30 not electrically connected to electrode 24 may be used only for fixing light-emitting module 20 without serving as a supplier of power to light-emitting module 20. The above-described supplemental items regarding holder 30 according to Embodiment 1 are also applied to holder 130 according to the above-described Embodiment 2, holder 230 according to the above-described Embodiment 3, and holder 330 illustrated in FIG. 21.

In addition, holder 30 holds light-emitting module 20 in the cantilever-style by clamping a part of light-emitting module 20 with holding component 35. However, holding component 35 may hold light-emitting module 20 by a different technique. Holder 30 may hold a part of light-emitting module 20 using an adhesive, a magnet, an adhesive disc, or the like, held by holding component 35. This is also applied to holder 130 according to the above-described Embodiment 2 and holder 330 illustrated in FIG. 21.

In addition, holder 130 according to the above-described Embodiment 2 may include holding component 35*a* according to Modification 3 of the above-described Embodiment 1. More specifically, holder 130 may perform temporarily fixing of light-emitting module 20 without using contact terminal 140. With this configuration, it is possible to temporarily fix holder 130 to light-emitting module 20 using relatively strong clamping fore of holding component 35*a*, without depending on the elastic force of contact terminal 140, for example.

In addition, power-line housing 38*b* according to the above-described Modification 2 of Embodiment 3 may: include opening 39 which is defined on a side facing base 12, and allows power line 90 to be inserted; and house power line 90 in such a manner that at least a part of power line 90 is bent between opening 39 and power-line connecting portion 37.

In addition, power-line housing 38*b* may be connected to insertion opening 32 defined at a surface of the side opposite to base 12 of main body 31, for example. In other words, power-line housing 38*b* may be capable of housing power line 90 inserted in each of two directions. In this case, it is only required that power-line connecting portion 37 of contact terminal 34 is shaped so as to be connectable to power lines 90 inserted in each of two directions.

In addition, light emitter 21 included in light-emitting module 20 includes one or more LED chips mounted on main surface 22*a* of substrate 22. However, light emitter 21 may include a surface-mount (SMD: surface mount device) LED in place of an LED chip. SMD-type LED is an LED device of a package-type formed by mounting an LED chip in a cavity and disposing a phosphor-containing resin in the cavity.

In addition, a light-emitting element employed as a light source by light-emitting module 20 is not limited to an LED, and a semiconductor light-emitting element such as a semiconductor laser, an organic EL (electro luminescence), or a light-emitting element such as an inorganic EL may be employed.

In addition, a light-emitting element employed as a light source by light-emitting module 20 in not necessarily a semiconductor light-emitting element, and a fluorescent tube, for example, may be employed.

Moreover, embodiments obtained through various modifications to the respective exemplary embodiments and modifications which may be conceived by a person skilled in the art as well as embodiments realized by arbitrarily combining the constituent elements and functions of the respective exemplary embodiments and modifications without materially departing from the spirit of the present disclosure are included in the present disclosure While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A holder included in a plurality of holders which fix, to a base, a light-emitting module to be provided on the base, by being attached to the base, the holder comprising:

a contact terminal to be electrically connected to the light-emitting module; and a holding component which holds the light-emitting module by clamping a part of the light-emitting module from a back surface and from a main surface opposite to the back surface, the back surface being a surface that comes into contact with the base, wherein the holding component includes:

a contact portion which is a portion of the contact terminal, and configured to be in contact with an electrode provided on the main surface of the light-emitting module; and a support plate provided at a position opposite to the contact portion, wherein the holding component clamps the part of the light-emitting module as a result of the holder being moved toward the light-emitting module in a direction parallel to the back surface of the light-emitting module, wherein the contact terminal is configured to cause the contact portion to move toward the support plate, by being subjected to a force from the light-emitting module when the holder is moved toward the light-emitting module in the direction parallel to the back surface, wherein the holding component further includes a button that moves by being pressed by the light-emitting module when the holder is moved toward the light-emitting module in the direction parallel to the back surface, and wherein the contact terminal is subjected to the force from the light-emitting module via the button.

2. The holder according to claim 1, further comprising a lock which locks the button when the button is moved as a result of being pressed by the light-emitting module, for preventing the button from moving in an opposite direction.

3. The holder according to claim 1, further comprising a main body including a screw attaching portion through which a screw for fixing the holder to the base penetrates, wherein the contact terminal is configured to cause the contact portion to move toward the support plate, by being subjected to force from the screw when the holder is fixed to the base by the screw.

4. The holder according to claim 3, wherein the holding component further includes a movable plate which moves as a result of being pressed by the screw when the holder is fixed to the base by the screw, and the contact terminal is subjected to force from the screw via the movable plate.

5. A lighting apparatus comprising:

a base;

a light-emitting module to be provided on the base; and a plurality of holders which fix the light-emitting module to the base, wherein each of the plurality of holders includes:

a contact terminal to be electrically connected to an electrode of the light-emitting module; and a holding component which holds the light-emitting module by clamping a part of the light-emitting module from a back surface and from a main surface opposite to the back surface, the back surface being a surface that comes into contact with the base, wherein the holding component includes:

a contact portion which is a portion of the contact terminal, and configured to be in contact with an electrode provided on the main surface of the light-emitting module; and a support plate provided at a position opposite to the contact portion, wherein the holding component clamps the part of the light-emitting module as a result of the holder being moved toward the light-emitting module in a direction parallel to the back surface of the light-emitting module, wherein the contact terminal is configured to cause the contact portion to move toward the support plate, by being subjected to a force from the light-emitting module when the holder is moved toward the light-emitting module in the direction parallel to the back surface, wherein the holding component further includes a button that moves by being pressed by the light-emitting module when the holder is moved toward the light-emitting module in the direction parallel to the back surface, and wherein the contact terminal is subjected to the force from the light-emitting module via the button.

* * * * *